US008730133B2

(12) United States Patent
Tanikame

(10) Patent No.: US 8,730,133 B2
(45) Date of Patent: May 20, 2014

(54) DISPLAY DEVICE AND ELECTRONIC DEVICE

(75) Inventor: Takao Tanikame, Kanagawa (JP)

(73) Assignee: Sony Corporation, Tokyo (JP)

( * ) Notice: Subject to any disclaimer, the term of this patent is extended or adjusted under 35 U.S.C. 154(b) by 1206 days.

(21) Appl. No.: 12/314,595

(22) Filed: Dec. 12, 2008

(65) Prior Publication Data

US 2009/0167646 A1 Jul. 2, 2009

(30) Foreign Application Priority Data

Dec. 27, 2007 (JP) ..... 2007-336792

(51) Int. Cl.
*G09G 3/30* (2006.01)

(52) U.S. Cl.
USPC ..... 345/76; 345/80

(58) Field of Classification Search
USPC ..... 345/76
See application file for complete search history.

(56) References Cited

U.S. PATENT DOCUMENTS

| | | | | |
|---|---|---|---|---|
| 7,057,588 | B2 | 6/2006 | Asano et al. | |
| 7,102,202 | B2 | 9/2006 | Kobayashi et al. | |
| 7,109,952 | B2 | 9/2006 | Kwon et al. | |
| 7,679,596 | B2 * | 3/2010 | Kim et al. | 345/98 |
| 8,243,057 | B2 * | 8/2012 | Shin | 345/213 |
| 2002/0097002 | A1 * | 7/2002 | Lai et al. | 315/169.3 |
| 2002/0126073 | A1 * | 9/2002 | Knapp et al. | 345/76 |
| 2003/0117423 | A1 * | 6/2003 | Brown et al. | 345/690 |
| 2005/0162363 | A1 * | 7/2005 | Kim | 345/92 |
| 2005/0206590 | A1 | 9/2005 | Sasaki et al. | |
| 2005/0243044 | A1 * | 11/2005 | Kang et al. | 345/87 |
| 2005/0264496 | A1 * | 12/2005 | Shin | 345/76 |
| 2005/0264497 | A1 * | 12/2005 | Shin et al. | 345/76 |
| 2006/0170628 | A1 * | 8/2006 | Yamashita et al. | 345/76 |
| 2007/0081196 | A1 * | 4/2007 | Divine et al. | 358/302 |
| 2008/0055256 | A1 * | 3/2008 | Kwong et al. | 345/173 |
| 2009/0251404 | A1 * | 10/2009 | Hwang et al. | 345/107 |

FOREIGN PATENT DOCUMENTS

| | | | |
|---|---|---|---|
| JP | 2001-027751 | A | 1/2001 |
| JP | 2002-040990 | A | 2/2002 |
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-293293 | A | 10/2006 |
| JP | 2007-011322 | A | 1/2007 |

OTHER PUBLICATIONS

Japanese Office Action issued Dec. 8, 2009 for corresponding Japanese Application No. 2007-336792.

* cited by examiner

*Primary Examiner* — Alexander S Beck
*Assistant Examiner* — Mihir Rayan
(74) *Attorney, Agent, or Firm* — Rader, Fishman & Grauer PLLC

(57) ABSTRACT

The present invention provides a display device includes: a pixel array section including a set of pixels arranged in a form of a matrix; and a driving section for driving the pixel array section.

20 Claims, 37 Drawing Sheets

DISPLAY DEVICE AND ELECTRONIC DEVICE

CROSS REFERENCES TO RELATED APPLICATIONS

The present invention contains subject matter related to Japanese Patent Application JP 2007-336792, filed in the Japan Patent Office on Dec. 27, 2007, the entire contents of which being incorporated herein by reference.

BACKGROUND OF THE INVENTION

1. Field of the Invention

The present invention relates to an active matrix type display device using a light emitting element in a pixel, and an electronic device incorporating such a display device.

2. Description of the Related Art

Development of flat-panel emissive display devices using an organic EL (electro luminescence) device as a light emitting element has recently been actively underway. The organic EL device uses a phenomenon in which an organic thin film emits light when an electric field is applied to the organic thin film. The organic EL device is driven with an applied voltage of 10 V or lower, and thus consumes low power. In addition, the organic EL device is a self-luminous element that emits light by itself. Therefore a need for an illuminating member is eliminated, and it is thus easy to achieve a reduction in weight and a reduction in thickness. Further, the organic EL device has a very high response speed of a few us, so that no afterimage occurs at a time of displaying a moving image.

Of flat-panel emissive display devices using an organic EL device in a pixel, active matrix type display devices having a thin film transistor formed as a driving element in each pixel in an integrated manner, in particular, are being actively developed. Active matrix type flat-panel emissive display devices are described in Japanese Patent Laid-Open Nos. 2003-255856, 2003-271095, 2004-133240, 2004-029791, 2004-093682 for example.

SUMMARY OF THE INVENTION

The existing display device has a flat panel structure in which a central pixel array section and a driving section in a peripheral region surrounding the pixel array section in the form of a frame are integrated and formed integrally with each other on a single panel. The pixel array section includes a set of pixels arranged in the form of a matrix, and forms a screen. The peripheral driving section drives the pixel array section to display an image on the screen in frame cycles.

The pixel array section has signal lines arranged in the form of columns and driving lines arranged in the form of rows. Each pixel is disposed at a part where each signal line intersects each driving line. The driving section includes a horizontal driving circuit for supplying a video signal to the signal lines in the form of columns and a vertical driving circuit for supplying a driving signal to the driving lines in the form of rows. Each pixel is activated by the driving signal, and then emits light at a luminance corresponding to the video signal, whereby an image is displayed on the pixel array section.

Recent display devices have higher definition and higher density, and therefore the number of pixel rows (number of horizontal lines) and the number of pixel columns (number of vertical lines) of the pixel array section have been increasing. With the increase in the number of vertical lines, the number of signal lines has also been increasing, of course. Thereby, the wiring density of signal lines in the pixel array section has become higher, which invites an increase in the percentage of defectives such as short-circuit defects or the like.

On the side of the peripheral driving section, the number of output stages of the horizontal driving circuit for supplying a video signal to the signal lines has also been increasing in such a manner as to correspond to the increasing number of signal lines. With the increase in the number of output stages including a switch element, the horizontal driving circuit has become complicated and increased in scale, which is a factor in increasing cost. In addition, with an increase in size of the horizontal driving circuit, the area of a peripheral frame region in which the peripheral driving section is laid out on the panel is increased, which hinders achievement of a narrower frame of the panel.

In view of the above-described problems of the existing techniques, it is desirable to provide a display device in which the number of signal lines can be reduced and a horizontal driving circuit can be simplified and miniaturized. For this, the following measures are taken. A display device according to an embodiment of the present invention includes: a pixel array section including a set of pixels arranged in a form of a matrix; and a driving section for driving the pixel array section. wherein the pixel array section has signal lines in a form of columns arranged at a ratio of one signal line to two pixel columns, first driving lines in a form of rows arranged at a ratio of one first driving line to one pixel row, and second driving lines in a form of rows similarly arranged at a ratio of one second driving line to one pixel row, a signal line is commonly connected to pixels of a corresponding pair of a left column and a right column, a first driving line is connected to pixels of a corresponding row, a second driving line is alternately connected to pixels in an upper row and pixels in a lower row with the second driving line between the upper row and the lower row. The driving section includes a horizontal driving circuit for supplying a video signal to the signal lines in the form of columns, a first vertical driving circuit for sequentially supplying a first driving signal to the first driving lines in the form of rows, and a second vertical driving circuit for sequentially supplying a second driving signal to the second driving lines in the form of rows, and each pixel is operated to emit light at a luminance corresponding to the video signal by the first driving signal and the second driving signal, whereby an image is displayed on the pixel array section.

Specifically, the driving section scans each pixel row once in a first field period, and scans each pixel row once again in a second field period, whereby an image of one frame is displayed on the pixel array section. In the first field period, the first vertical driving circuit sequentially scans the first driving lines and supplies a first driving signal to the first driving lines row by row, while the second vertical driving circuit selectively scans one of a group of the odd-numbered second driving lines and a group of the even-numbered second driving lines and supplies a second driving signal to the one of the groups, whereby half of pixels included in a pair of a left column and a right column commonly connected to each signal line are operated to emit light, and in the second field period. The first vertical driving circuit sequentially scans the first driving lines and supplies the first driving signal to the first driving lines row by row, while the second vertical driving circuit selectively scans the other of the group of the odd-numbered second driving lines and the group of the even-numbered second driving lines and supplies the second driving signal to the other of the groups, whereby the other half of the pixels included in the pair of the left column and the right column commonly connected to each signal line are operated to emit light. In one mode, each of the pixels includes a sampling transistor, a driving transistor, a storage capacitor, and a light emitting element, a control terminal of the sampling transistor is connected to a scanning line formed by one of a first driving line and a second driving line, a pair of current terminals of the sampling transistor is connected to a signal line and a control terminal of the driving transistor. One of a pair of current terminals of the driving transistor is connected to the light emitting element, and the other of the pair of current terminals of the driving transistor is connected to a feeding line formed by the other of the first driving line and the second driving line, and the storage capacitor is connected between the control terminal and current terminal of the driving transistor, and in the pixel. The sampling transistor is turned on in response to a driving signal supplied from the scanning line to sample a video signal from the signal line and write the video signal to the storage capacitor, and the driving transistor operates in response to a driving signal supplied from the feeding line to supply a driving current corresponding to the video signal written to the storage capacitor to the light emitting element. Preferably, the pixel performs correcting operation according to the driving signals supplied from the scanning line and the feeding line before writing the video signal to the storage capacitor, whereby the pixel adds an amount of correction for cancelling a variation in threshold voltage of the driving transistor to the storage capacitor. In some cases, the pixel repeats the correcting operation a plurality of times on a time division basis. In addition, the pixel subtracts an amount of correction for cancelling a variation in mobility of the driving transistor from the storage capacitor when writing the video signal to the storage capacitor.

According to an embodiment of the present invention, an active matrix type display device is configured such that the output of one of a pair of vertical driving circuits that determine the driving of pixels is alternately input to pixels adjacent to each other in an upper row and a lower row. Thereby, a signal line extending in a vertical direction from each output stage of a horizontal driving circuit can be shared between pixels adjacent to each other in a left column and a right column. By sharing one signal line between pixels in two columns, the total number of signal lines can be halved. It is possible to lower the wiring density of signal lines on the pixel array section, and reduce the percentage of defectives such as short-circuit defects of pixel circuits or the like. In addition, by halving the total number of signal lines, it is possible to reduce the number of output terminals of the horizontal driving circuit (drive IC) that outputs a video signal to each signal line. Thereby the horizontal driving circuit can be simplified and miniaturized, which contributes to a reduced manufacturing cost. In addition, the miniaturization of the horizontal driving circuit reduces the layout area of a peripheral driving section, and is thus effective in achieving a narrower frame of the panel.

BRIEF DESCRIPTION OF THE DRAWINGS

FIG. 6I is a diagram similarly of assistance in explaining the operation of the display device according to the embodiment of the present invention;

DETAILED DESCRIPTION OF PREFERRED EMBODIMENT

Figure 1A:
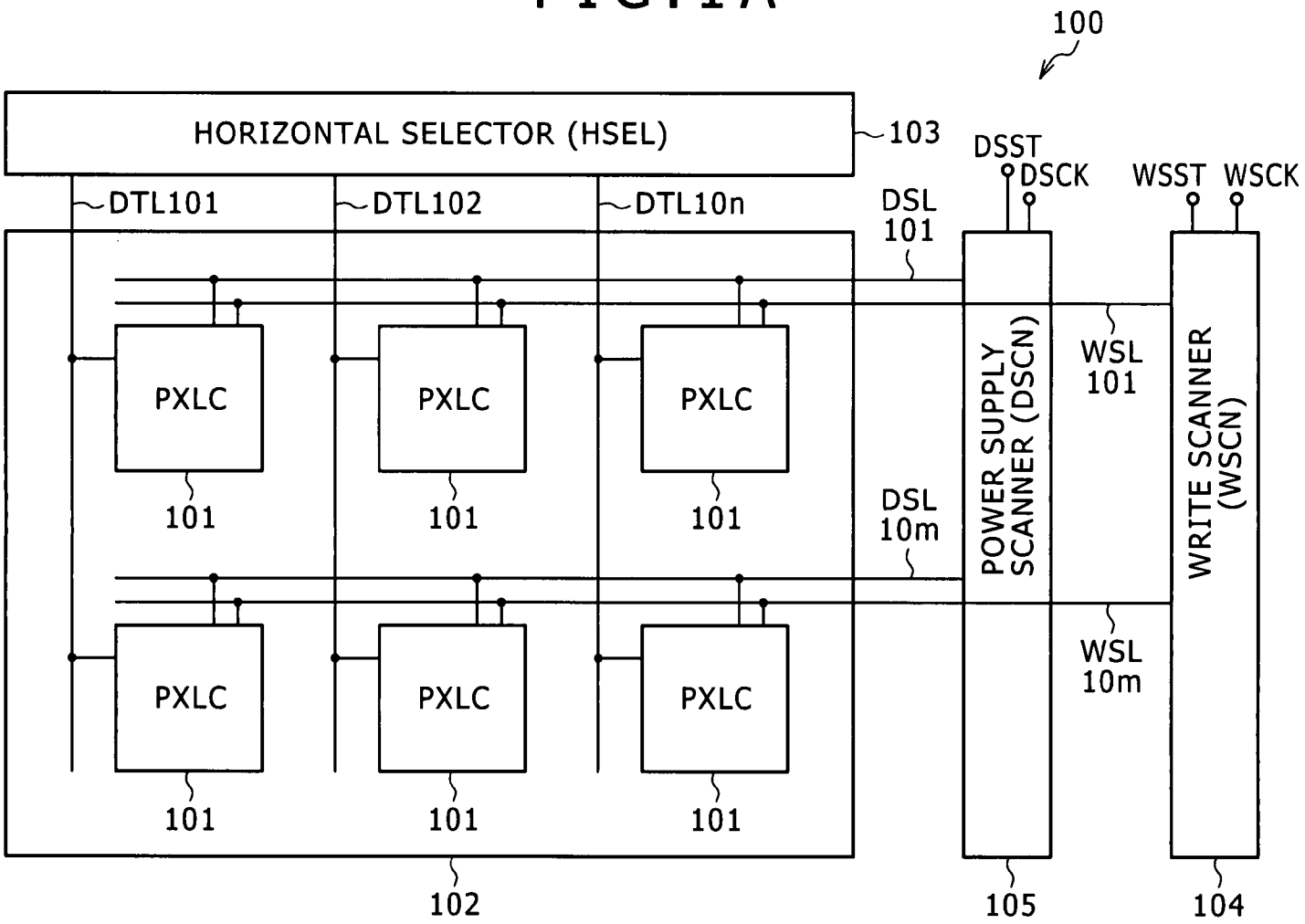
FIG. 1A is a block diagram showing a general configuration of a display device according to a reference example.

Preferred embodiment of the present invention will hereinafter be described in detail with reference to the drawings. First, in order to clarify the background of the present invention and facilitate understanding, an ordinary configuration of an active matrix type display device will be described as a reference example. FIG. 1A is a block diagram showing a general configuration of the display device according to the reference example. As shown in FIG. 1A, the display device 100 includes a pixel array section 102 and a driving section (103, 104, and 105) for driving the pixel array section 102. The pixel array section 102 includes scanning lines WSL101 to WSL10*m* in the form of rows, signal lines DTL101 to DTL10*n* in the form of columns, pixels (PIX) 101 in the form of a matrix which pixels are arranged at parts where the scanning lines WSL101 to WSL10*m* intersect the signal lines DTL101 to DTL10*n* , and feeding lines DSL101 to DSL10*m* arranged so as to correspond to the respective rows of the pixels 101. The driving section (103, 104, and 105) includes: a main scanner (write scanner WSCN) 104 for sequentially supplying a control signal to each of the scanning lines WSL101 to WSL10*m* , and thereby performing line-sequential scanning of the pixels 101 in row units; a power supply scanner (DSCN) 105 for supplying a power supply voltage changed between a first potential and a second potential to each of the feeding lines DSL101 to DSL10*m* in accordance with the line-sequential scanning; and a signal selector (horizontal selector HSEL) 103 for supplying a signal potential as a video signal and a reference potential to the signal lines DTL101 to DTL10*n* in the form of columns in accordance with the line-sequential scanning.

The write scanner 104 includes a shift register. The shift register operates according to a clock signal WSCK supplied externally. The shift register sequentially transfers a start pulse WSST similarly supplied externally, and thereby generates a shift pulse serving as a source of the control signal. The power supply scanner 105 is also formed by using a shift register. The shift register sequentially transfers an externally supplied start pulse DSST according to an externally supplied clock signal DSCK, and thereby controls the changing of the potential of each feeding line DSL.

In the present example, the write scanner (WSCN) is one of a first vertical driving circuit and a second vertical driving circuit, and the power supply scanner (DSCN) is the other of the first vertical driving circuit and the second vertical driving circuit. A scanning line WSL is one of a first driving line and a second driving line, and a feeding line DSL is the other of the first driving line and the second driving line. The horizontal selector (HSEL) corresponds to a horizontal driving circuit. Thus, the peripheral driving section of the active matrix type display device generally includes one horizontal driving circuit and at least two vertical driving circuits. The peripheral driving section including these driving circuits 103, 104, and 105 is laid out on a same panel as the pixel array section 102 in the center.

Figure 1B:
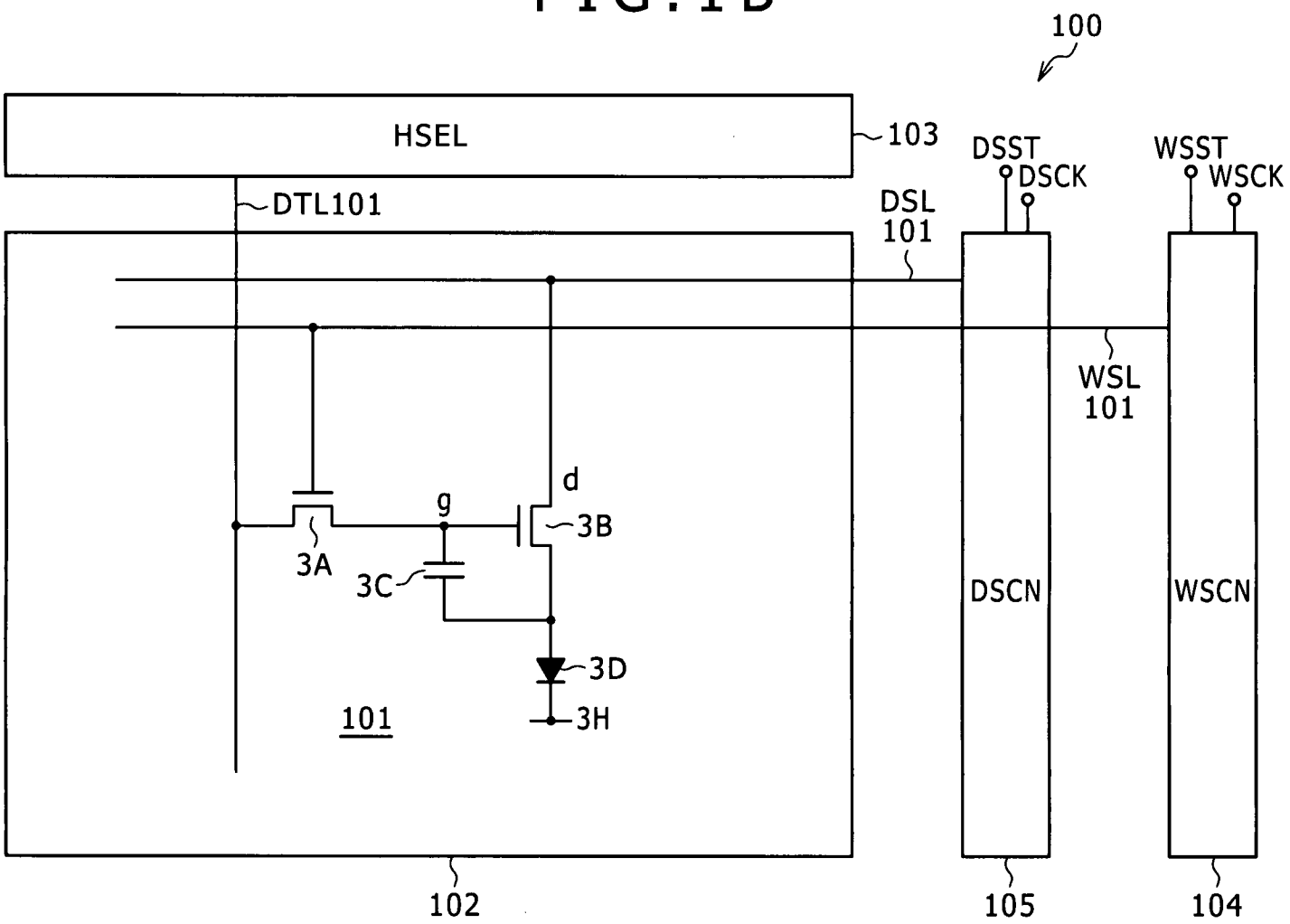
FIG. 1B is a circuit diagram showing a configuration of a pixel included in the display device shown in FIG. 1A.

FIG. 1B is a circuit diagram showing a concrete configuration and connection relation of a pixel 101 included in the display device 100 shown in FIG. 1A. As shown in FIG. 1B, the pixel 101 includes a light emitting element 3D typified by an organic EL device or the like, a sampling transistor 3A, a driving transistor 3B, and a storage capacitor 3C. The gate of the sampling transistor 3A is connected to the corresponding scanning line WSL101, one of the source and the drain of the sampling transistor 3A is connected to the corresponding signal line DTL101, and the other of the source and the drain of the sampling transistor 3A is connected to the gate g of the driving transistor 3B. One of the source s and the drain d of the driving transistor 3B is connected to the light emitting element 3D, and the other of the source s and the drain d of the driving transistor 3B is connected to the corresponding feeding line DSL101. In the present reference example, the driving transistor 3B is of an N-channel type, and the drain d of the driving transistor 3B is connected to the feeding line DSL101, while the source s of the driving transistor 3B is connected to the anode of the light emitting element 3D. The cathode of the light emitting element 3D is connected to grounding wiring 3H. Incidentally, the grounding wiring 3H is arranged as wiring common to all the pixels 101. The storage capacitor 3C is connected between the source s and the gate g of the driving transistor 3B.

In such a configuration, the sampling transistor 3A conducts in response to a control signal supplied from the scanning line WSL101 to sample a signal potential supplied from the signal line DTL101 and retain the signal potential in the storage capacitor 3C. The driving transistor 3B is supplied with a current from the feeding line DSL101 at a first potential (high potential), and sends a driving current to the light emitting element 3D according to the signal potential retained in the storage capacitor 3C. The main scanner (WSCN) 104 outputs a control signal of a predetermined pulse width to the scanning line WSL101 so that the sampling transistor 3A is set in a conducting state during a time period during which the signal line DTL101 is at the signal potential. Thereby, the signal potential is retained in the storage capacitor 3C, and simultaneously a correction for the mobility u of the driving transistor 3B is added to the signal potential.

The pixel circuit 101 shown in FIG. 1B has not only the above-described mobility correcting function but also a threshold voltage correcting function. Specifically, the power supply scanner (DSCN) 105 changes the feeding line DSL101 from the first potential (high potential) to a second potential (low potential) in first timing before the sampling transistor 3A samples the signal potential. The main scanner (WSCN) 104 makes the sampling transistor 3A conduct to apply the reference potential from the signal line DTL101 to the gate g of the driving transistor 3B and set the source s of the driving transistor 3B to the second potential in second timing similarly before the sampling transistor 3A samples the signal potential. While the above-described first timing generally precedes the second timing, the first timing and the second timing may be reversed in some cases. In third timing after the second timing, the power supply scanner (DSCN) 105 changes the feeding line DSL101 from the second potential to the first potential to retain a voltage corresponding to a threshold voltage Vth of the driving transistor 3B in the storage capacitor 3C. By such a threshold voltage correcting function, the display device 100 can cancel the effect of the threshold voltage of the driving transistor 3B which threshold voltage varies in each pixel.

The pixel circuit 101 shown in FIG. 1B further has a bootstrap function. Specifically, the main scanner (WSCN) 104 cancels the application of the control signal to the scanning line WSL101 in a stage where the signal potential is retained in the storage capacitor 3C. The main scanner (WSCN) 104 thereby sets the sampling transistor 3A in a non-conducting state and electrically disconnects the gate g of the driving transistor 3B from the signal line DTL101. Hence, the gate potential (Vg) of the driving transistor 3B is interlocked with variation in the source potential (Vs) of the driving transistor 3B, and a voltage Vgs between the gate g and the source s can be held constant.

Figure 2A:
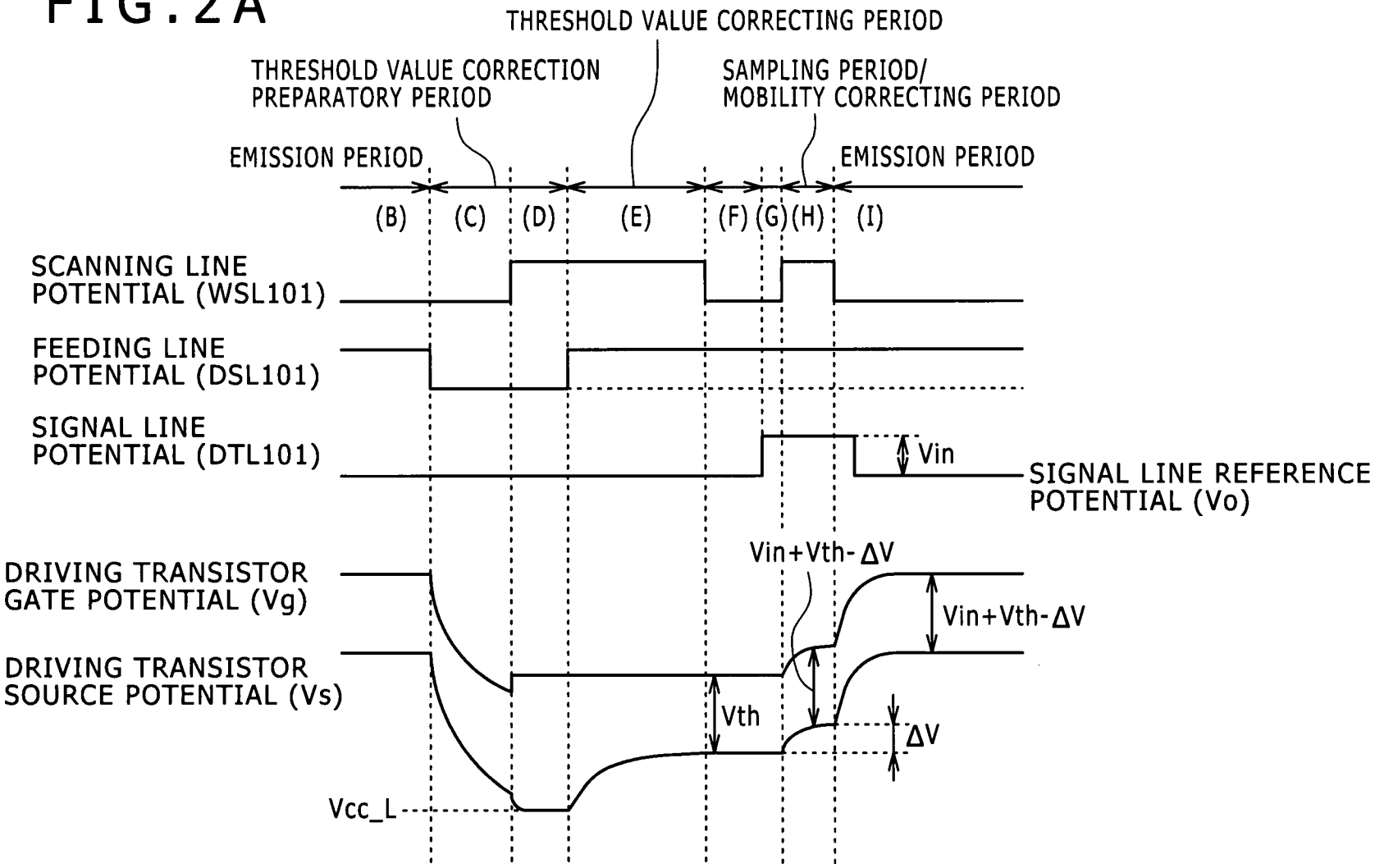
FIG. 2A is a timing chart of assistance in explaining the operation of the display device according to the reference example.

FIG. 2A is a timing chart of assistance in explaining the operation of the pixel 101 shown in FIG. 1B. Changes in potential of the scanning line (WSL101), changes in potential of the feeder line (DSL101), and changes in potential of the signal line (DTL101) are shown along a common time axis. In parallel with these potential changes, changes in the gate potential (Vg) and the source potential (Vs) of the driving transistor 3B are also shown.

This timing chart has periods (B) to (I) divided for convenience according to transitions of the operation of the pixel 101. In the emission period (B), the light emitting element 3D is in an emitting state. Then, in the first period (C) after a new field of line-sequential scanning begins, the power supply line is changed to the low potential. In the next period (D), the gate potential Vg and the source potential Vs of the driving transistor are initialized. A preparation for threshold voltage correcting operation is completed by resetting the gate potential Vg and the source potential Vs of the driving transistor 3B in the threshold value correction preparatory periods (C) and (D). In the next threshold value correcting period (E), the threshold voltage correcting operation is actually performed, so that a voltage corresponding to the threshold voltage Vth is retained between the gate g and the source s of the driving transistor 3B. In actuality, the voltage corresponding to the threshold voltage Vth is written to the storage capacitor 3C connected between the gate g and the source s of the driving transistor 3B.

Then, after the passage of the preparatory periods (F) and (G) for mobility correction, the sampling period/mobility correcting period (H) begins. In this period, the signal potential Vin of a video signal is written to the storage capacitor 3C in such a manner as to be added to the threshold voltage Vth, and a voltage AV for mobility correction is subtracted from the voltage retained in the storage capacitor 3C. In this sampling period/mobility correcting period (H), to set the sampling transistor 3A in a conducting state during a time period during which the signal line DTL101 is at the signal potential Vin, a control signal of a shorter pulse width than the time period is output to the scanning line WSL101. Thereby, the signal potential Vin is retained in the storage capacitor 3C, and simultaneously a correction for the mobility μ of the driving transistor 3B is added to the signal potential Vin.

Then, in the emission period (I), the light emitting element starts emitting light at a luminance corresponding to the signal voltage Vin. At this time, because the signal voltage Vin is adjusted by the voltage corresponding to the threshold voltage Vth and the voltage ΔV for mobility correction, the light emission luminance of the light emitting element 3D is not affected by variations in the threshold voltage Vth and the mobility μ of the driving transistor 3B. Incidentally, bootstrap operation is performed at the beginning of the emission period (I), so that the gate potential Vg and the source potential Vs of the driving transistor 3B rise while the gate-to-source voltage Vgs=Vin+Vth−ΔV of the driving transistor 3B is held constant.

Figure 2B:
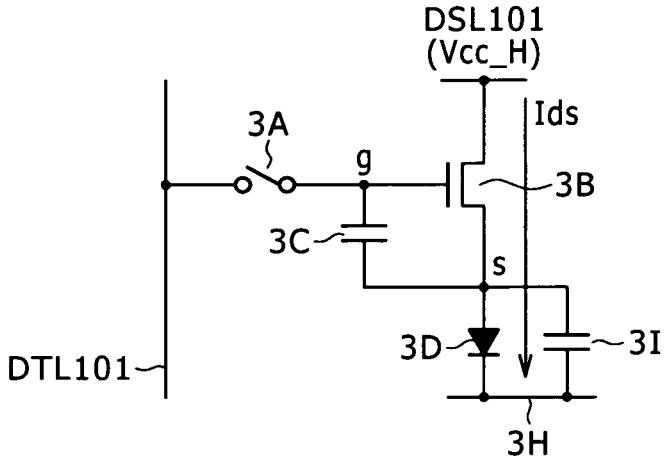
FIG. 2B is a schematic diagram similarly of assistance in explaining the operation.

The operation of the pixel 101 shown in FIG. 1B will continue being described in detail with reference to FIGS. 2B to 2I. Incidentally, the drawing numbers of FIGS. 2B to 2I correspond to the respective periods (B) to (I) of the timing chart shown in FIG. 2A. In order to facilitate understanding, and for convenience of description, FIGS. 2B to 2I show the capacitive component of the light emitting element 3D as a capacitive element 3I. First, as shown in FIG. 2B, in the emission period (B), the power supply line DSL101 is at a high potential Vcc_H (first potential), and the driving transistor 3B supplies a driving current Ids to the light emitting element 3D. As shown in FIG. 2B, the driving current Ids passes through the light emitting element 3D from the power supply line DSL101 at the high potential Vcc_H via the driving transistor 3B, and then flows into the common grounding wiring 3H.

Figure 2C:
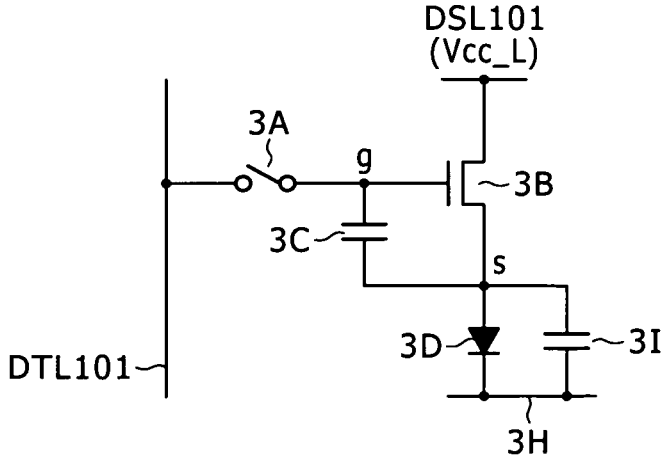
FIG. 2C is a schematic diagram similarly of assistance in explaining the operation.

When the next period (C) begins, as shown in FIG. 2C, the power supply line DSL101 is changed from the high potential Vcc_H to a low potential Vcc_L. Thereby, the power supply line DSL101 is discharged to the low potential Vcc_L, and the source potential Vs of the driving transistor 3B makes a transition to a potential close to the low potential Vcc_L. When the power supply line DSL101 has a high wiring capacitance, the power supply line DSL101 is desirably changed from the high potential Vcc_H to the low potential Vcc_L in relatively early timing. Effects of the wiring capacitance and other pixel parasitic capacitances are eliminated by securing this period (C) sufficiently.

Figure 2D:
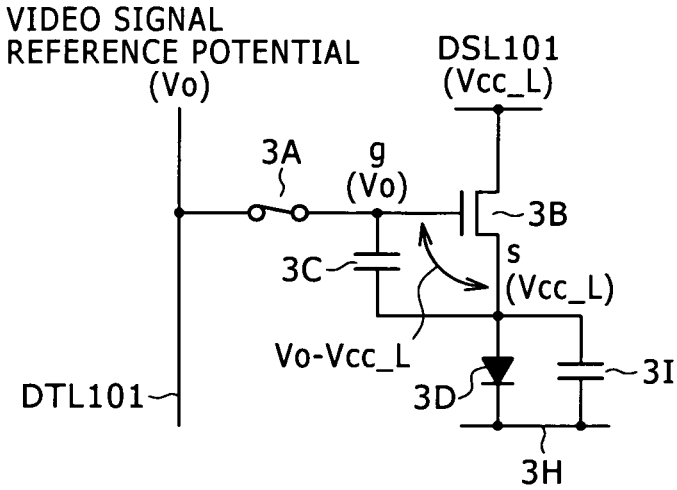
FIG. 2D is a schematic diagram similarly of assistance in explaining the operation.

When the next period (D) begins, as shown in FIG. 2D, the scanning line WSL101 is changed from a low level to a high level, whereby the sampling transistor 3A is set in a conducting state. At this time, the video signal line DTL101 is at the reference potential Vo. Thus, the gate potential Vg of the driving transistor 3B is set to the reference potential Vo of the video signal line DTL101 through the sampling transistor 3A in the conducting state. At the same time, the source potential Vs of the driving transistor 3B is immediately fixed to the low potential Vcc_L. Thus, the source potential Vs of the driving transistor 3B is initialized (reset) to the potential Vcc_L sufficiently lower than the reference potential Vo of the video signal line DTL. Specifically, the low potential Vcc_L (second potential) of the power supply line DSL101 is set such that the gate-to-source voltage Vgs (difference between the gate potential Vg and the source potential Vs) of the driving transistor 3B is larger than the threshold voltage Vth of the driving transistor 3B.

Figure 2E:
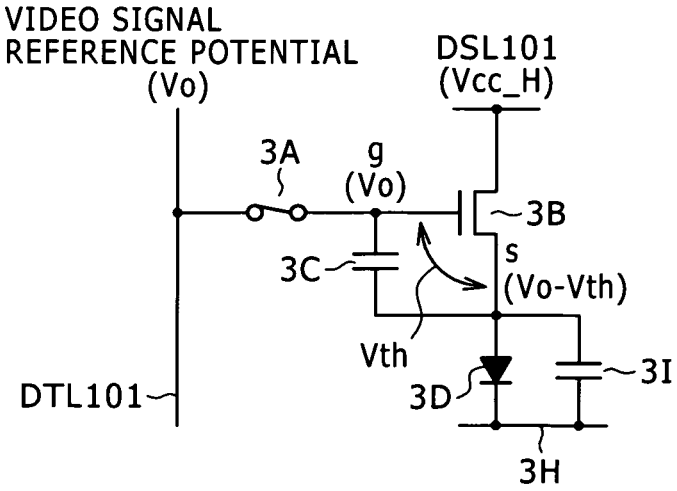
FIG. 2E is a schematic diagram similarly of assistance in explaining the operation.

When the next threshold value correcting period (E) begins, as shown in FIG. 2E, the power supply line DSL101 makes a transition from the low potential Vcc_L to the high potential Vcc_H, and the source potential Vs of the driving transistor 3B starts rising. Eventually current is cut off when the gate-to-source voltage Vgs of the driving transistor 3B becomes the threshold voltage Vth. A voltage corresponding to the threshold voltage Vth of the driving transistor 3B is thus written to the storage capacitor 3C. This is the threshold voltage correcting operation. In order for the current to flow only to the side of the storage capacitor 3C and not to flow to the side of the light emitting element 3D at this time, the potential of the common grounding wiring 3H is set such that the light emitting element 3D is cut off.

Figure 2F:
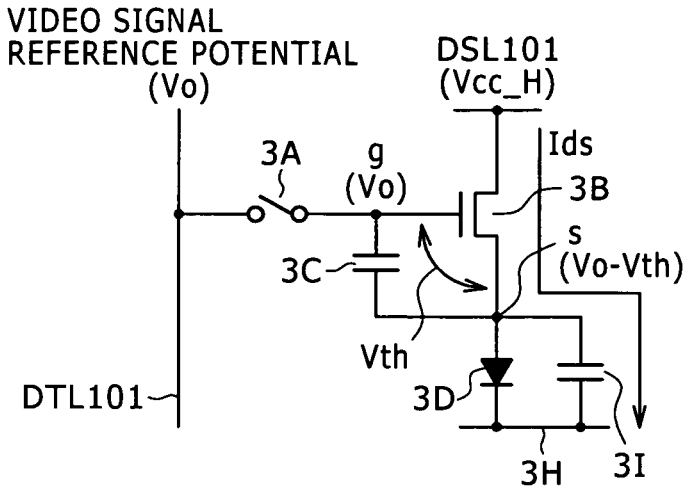
FIG. 2F is a schematic diagram similarly of assistance in explaining the operation.

When the period (F) begins, as shown in FIG. 2F, the scanning line WSL101 makes a transition to the low potential side, so that the sampling transistor 3A is temporarily set in an off state. At this time, while the gate g of the driving transistor 3B is in a floating state, the gate-to-source voltage Vgs is equal to the threshold voltage Vth of the driving transistor 3B and is thus in a cutoff state, so that drain current Ids does not flow.

Figure 2G:
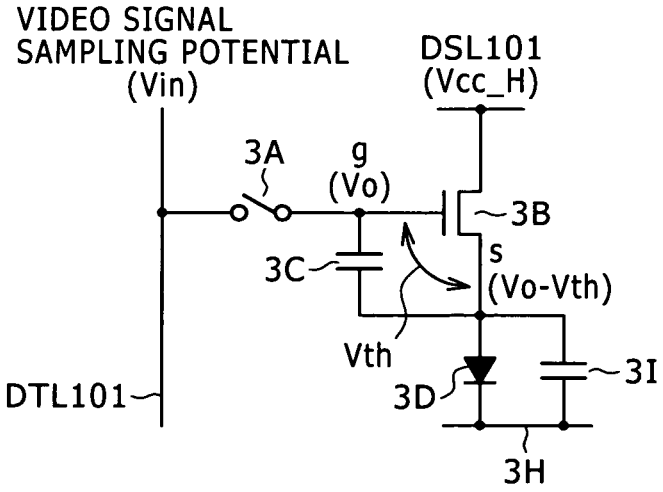
FIG. 2G is a schematic diagram similarly of assistance in explaining the operation.

When the next period (G) begins, as shown in FIG. 2G, the potential of the video signal line DTL101 makes a transition from the reference potential Vo to a sampling potential (signal potential) Vin. Thereby a preparation for next sampling operation and mobility correcting operation is completed.

Figure 2H:
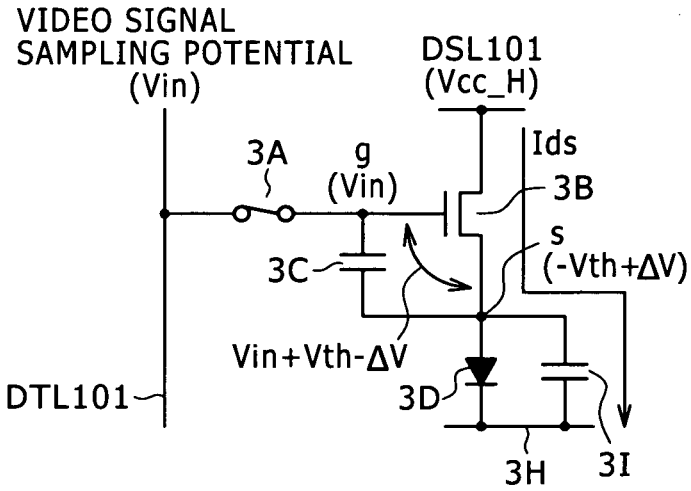
FIG. 2H is a schematic diagram similarly of assistance in explaining the operation.

When the sampling period/mobility correcting period (H) begins, as shown in FIG. 2H, the scanning line WSL101 makes a transition to the high potential side to set the sampling transistor 3A in an on state. The gate potential Vg of the driving transistor 3B therefore becomes the signal potential Vin. At this point, because the light emitting element 3D is initially in a cutoff state (high-impedance state), the drain-to-source current Ids of the driving transistor 3B flows into the light emitting element capacitance 3I to start charging. Therefore the source potential Vs of the driving transistor 3B starts rising. The gate-to-source voltage Vgs of the driving transistor 3B eventually becomes Vin+Vth−ΔV. Thus, the sampling of the signal potential Vin and the adjustment of the amount of correction ΔV are performed simultaneously. The higher the signal potential Vin, the larger the current Ids, and the higher the absolute value of the amount of correction ΔV. Hence, a mobility correction is made according to the level of light emission luminance. When the signal potential Vin is fixed, the higher the mobility μ0 of the driving transistor 3B, the higher the absolute value of the amount of correction ΔV. In other words, the higher the mobility μ, the larger the amount of negative feedback ΔV. Therefore variations in mobility μ of each pixel can be removed.

Figure 2I:
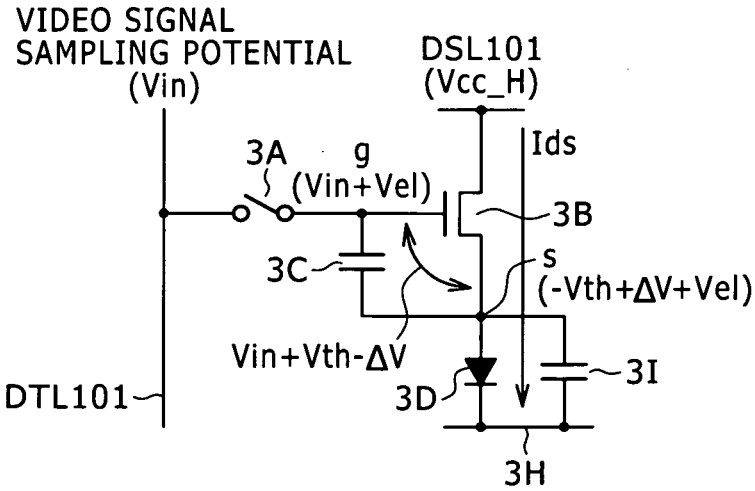
FIG. 2I is a schematic diagram similarly of assistance in explaining the operation.

Finally, when the emission period (I) begins, as shown in FIG. 2I, the scanning line WSL101 makes a transition to the low level side to set the sampling transistor 3A in an off state. The gate g of the driving transistor 3B is thereby disconnected from the signal line DTL101. At the same time, the drain current Ids starts to flow through the light emitting element 3D. The anode potential of the light emitting element 3D thereby rises by an amount Vel according to the driving current Ids. The rise in the anode potential of the light emitting element 3D is none other than a rise in the source potential Vs of the driving transistor 3B. When the source potential Vs of the driving transistor 3B rises, the gate potential Vg of the driving transistor 3B also rises in such a manner as to be interlocked with the source potential Vs of the driving transistor 3B due to the bootstrap operation of the storage capacitor 3C. An amount Vel of the rise in the gate potential Vg is equal to the amount Vel of the rise in the source potential Vs. Thus the gate-to-source voltage Vgs of the driving transistor 3B is held constant at Vin+Vth−ΔV during the emission period.

Figure 3A:
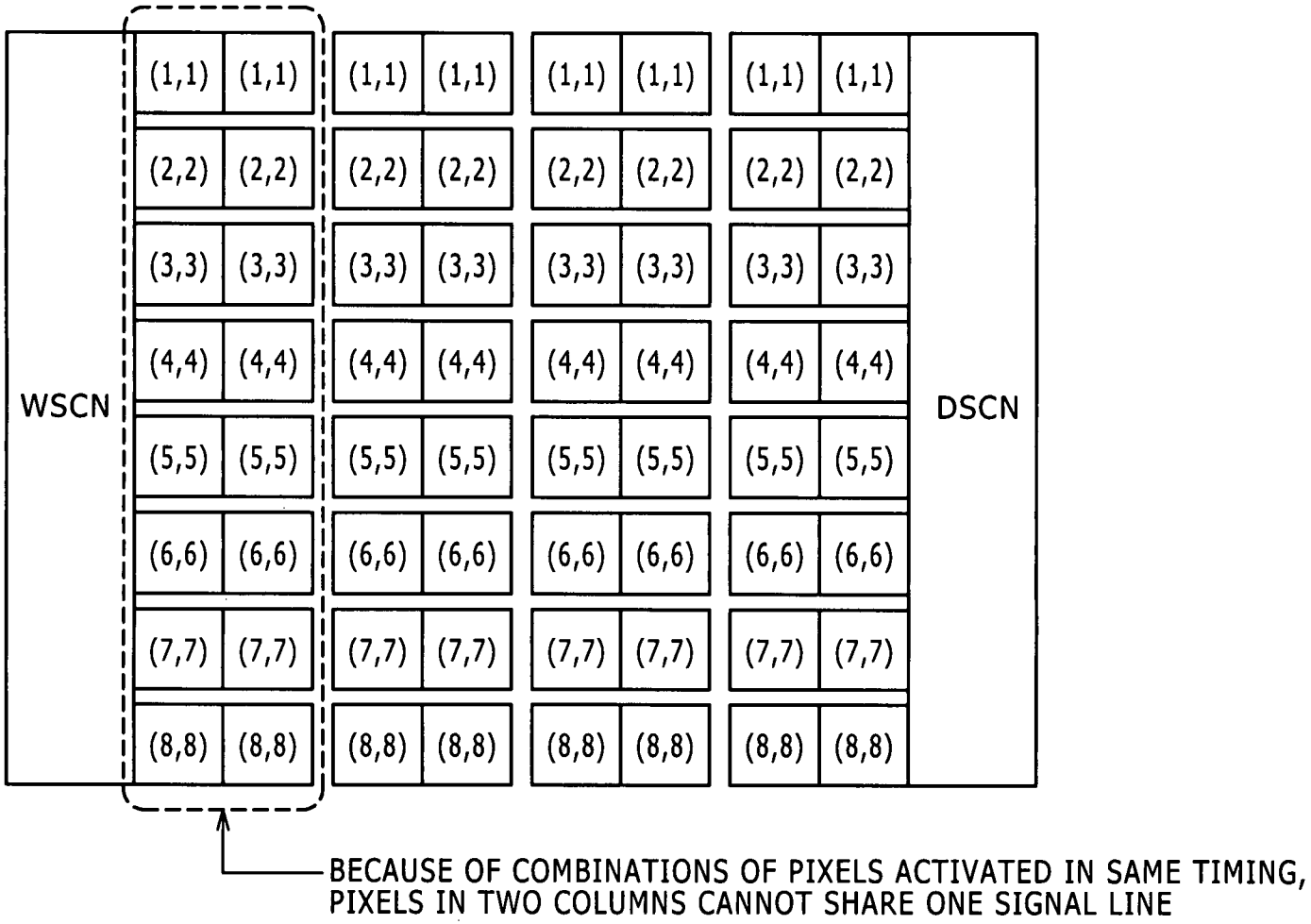
FIG. 3A is a schematic diagram of an operating system of the display device according to the reference example.

FIG. 3A is a schematic block diagram showing line-sequential scanning of pixels of the display device according to the reference example shown in FIG. 1A. For simplicity, a set of pixels forming the pixel array section is an 8×8 pixel matrix. That is, the number of pixel rows (horizontal lines) is eight, and the number of pixel columns (vertical lines) is also eight. A first vertical driving circuit WSCN and a second vertical driving circuit DSCN perform line-sequential scanning of the pixel array section in row units (horizontal line units). The eight pixels in the first line are selected to be set in an active state by a first output of the first vertical driving circuit WSCN and a first output of the second vertical driving circuit DSCN. To represent this, (1, 1) is added to each of the pixels in the first row (first line). The first number 1 indicates that the pixels are selected by a first output stage of the first vertical driving circuit WSCN, and the subsequent number 1 indicates that the pixels are set in a selected state by the first output of the second vertical driving circuit DSCN. As is clear from the figure, all the pixels in the first line are set active by the first output of the first vertical driving circuit WSCN and the first output of the second vertical driving circuit DSCN, and then perform a predetermined light emitting operation.

(2, 2) is added to the pixels in the second line. That is, the pixels in the second line are set active by a second output of the first vertical driving circuit WSCN and a second output of the second vertical driving circuit DSCN. Incidentally, there is a phase difference of one horizontal period (one H) between the first line and the second line. Thereafter line-sequential scanning progresses in order, and the pixels in the last eighth row are set active by an eighth output of the first vertical driving circuit WSCN and an eighth output of the second vertical driving circuit DSCN. Thereby, line-sequential scanning for one frame is completed, so that an image of one frame is displayed on the pixel array section.

The pixels of each line when activated by the pair of the vertical driving circuits WSCN and DSCN sample a video signal supplied from a signal line, and emit light at a luminance corresponding to the video signal. Pixels on a same line are all set in an active state in same timing. Thus, a signal line (vertical line) cannot be made common to a left pixel and a right pixel adjacent to each other, and each signal line needs to be laid out so as to correspond to each of the columns of the pixels. If a signal line is shared by a left pixel column and a right pixel column in the line-sequential scanning shown in FIG. 3A, a same video signal is always written to the left and right pixels, so that a normal image cannot be displayed.

Figure 3B:
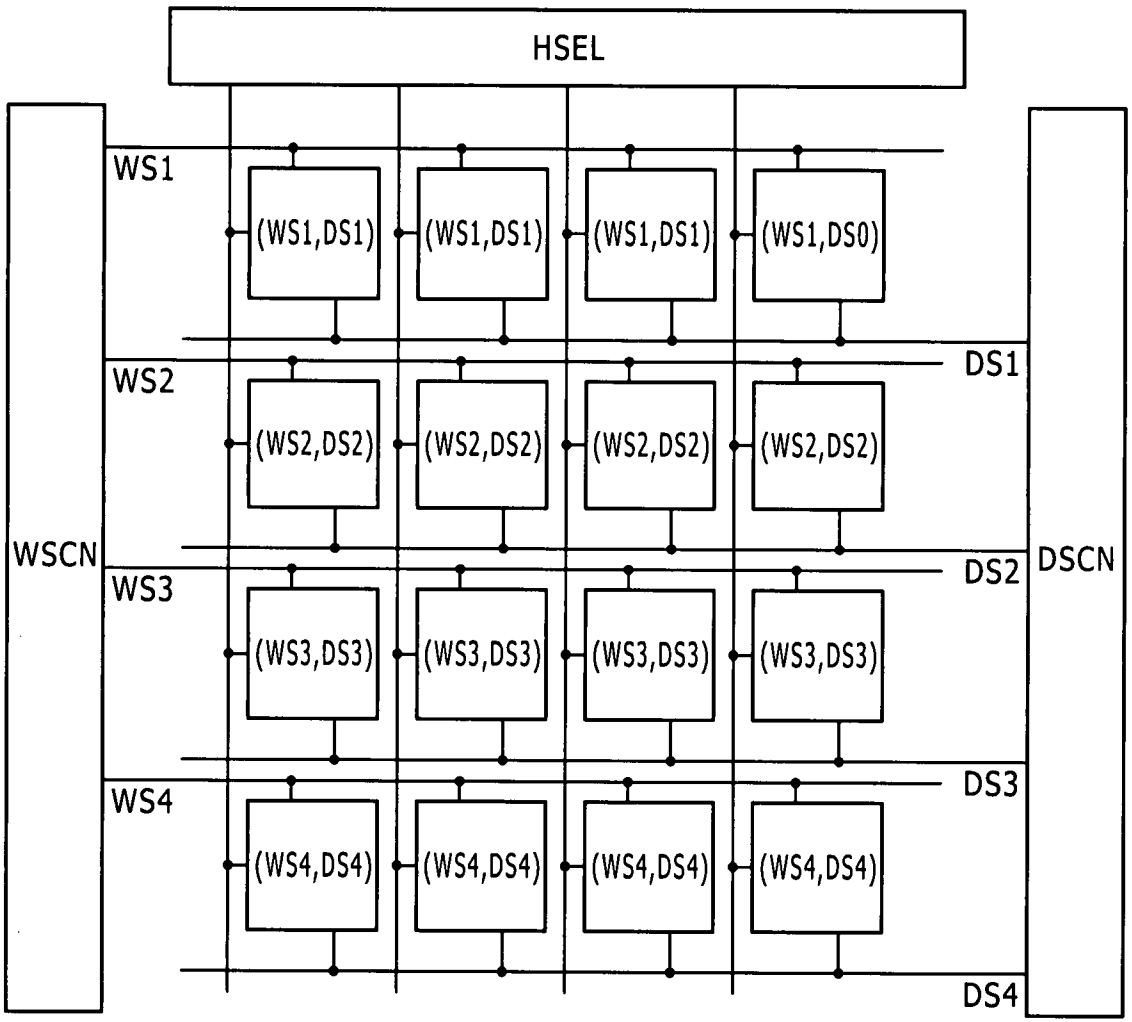
FIG. 3B is a diagram of wiring of the display device according to the reference example.

FIG. 3B is a block diagram showing a concrete layout of the display device according to the reference example shown schematically in FIG. 3A. In order to simplify illustration, however, only pixels of four rows by four columns of the pixel array section are shown. As shown in FIG. 3B, in the pixel array section, first driving lines WS are laid out so as to correspond to respective pixel rows (horizontal lines). Second driving lines DS are similarly laid out so as to correspond to the respective horizontal lines. Signal lines are laid out so as to correspond to respective pixel columns (vertical lines). The first driving lines WS are driven by the first vertical driving circuit WSCN. The outputs of the first vertical driving circuit WSCN are denoted by WS1, WS2, WS3, and WS4. The references also denote the corresponding first driving lines. On the other hand, the second driving lines DS are connected to the second vertical driving circuit DSCN. The outputs of the second vertical driving circuit DSCN are denoted by DS1, DS2, DS3, and DS4. The references also denote the corresponding second driving lines. On the other hand, the signal lines are connected to the horizontal driving circuit HSEL. As is clear from FIG. 3B, the horizontal driving circuit HSEL has output sections equal in number to the number of signal lines. With increases in definition and density of the pixel array section, an increase in the number of signal lines invites a corresponding increase in complexity and size of the horizontal driving circuit HSEL, thus becoming a factor in increased cost. In addition, in the pixel array section, with an increase in the number of signal lines, wiring density becomes higher, and the probability of a short-circuit defect is increased.

Figure 4A:
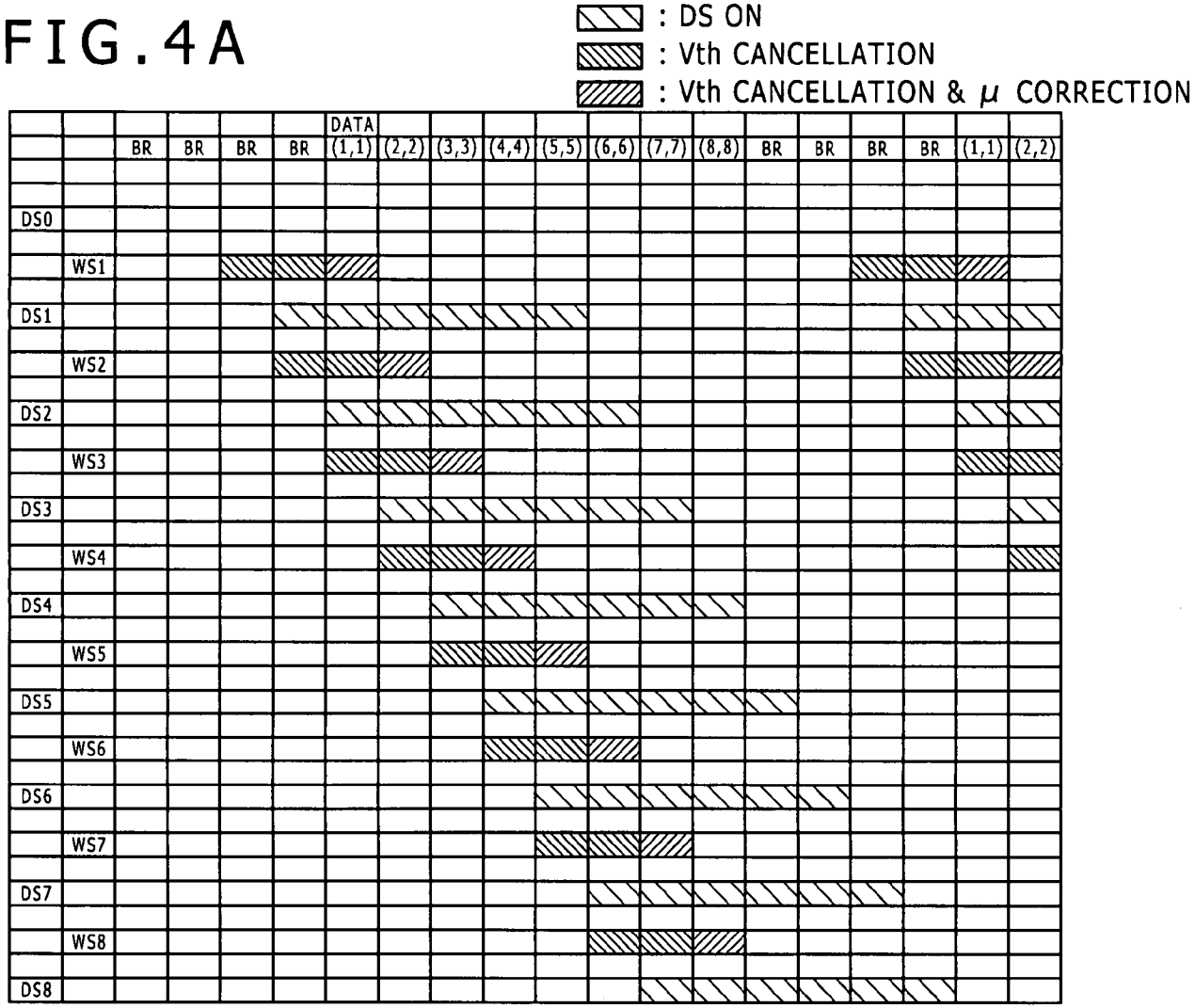
FIG. 4A is a block chart showing an operation sequence of the display device according to the reference example.

FIG. 4A is a block chart showing an operation sequence for one frame of the display device according to the reference example shown in FIG. 3A. As shown in FIG. 4A, one frame period is interposed between a preceding vertical blanking period BR and a succeeding vertical blanking period BR. Each vertical blanking period BR has a time length of four horizontal periods (four Hs). One frame period includes eight Hs. In each horizontal period (H), a video signal DATA for one line is written to a corresponding pixel row. In a first horizontal period of one frame period, a video signal DATA (1, 1) is written to the pixel row of the first line. In a last horizontal period of the frame period, a video signal DATA(8, 8) is written to the pixels in the eighth row (eighth line).

Meanwhile, the first vertical driving circuit operates on a line-sequential basis in one frame period to sequentially output outputs WS1 to WS8 to the corresponding first driving lines. The second vertical driving circuit also sequentially supplies outputs DS1 to DS8 to the corresponding second driving lines in one frame period. The first vertical driving circuit and the second vertical driving circuit both output the corresponding driving signals to the corresponding driving lines with a phase difference of one H.

In response to the output WS, the pixels perform threshold voltage correcting operation (Vth cancelling operation), signal writing, and mobility correcting operation. In the illustrated example, the pixels perform the Vth cancelling operation on a time division basis over three horizontal periods (three Hs). Incidentally, the pixels perform both the Vth cancelling operation and the mobility correcting operation in the last horizontal period. Meanwhile, in response to the output DS of the second vertical driving circuit, the pixels are set in a lit state, and emit light according to a video signal. The output WS of the first vertical driving circuit and the output DS of the second vertical driving circuit temporally overlap each other. The pixels can normally perform the Vth cancelling operation in the temporally overlapping parts.

Figure 4B:
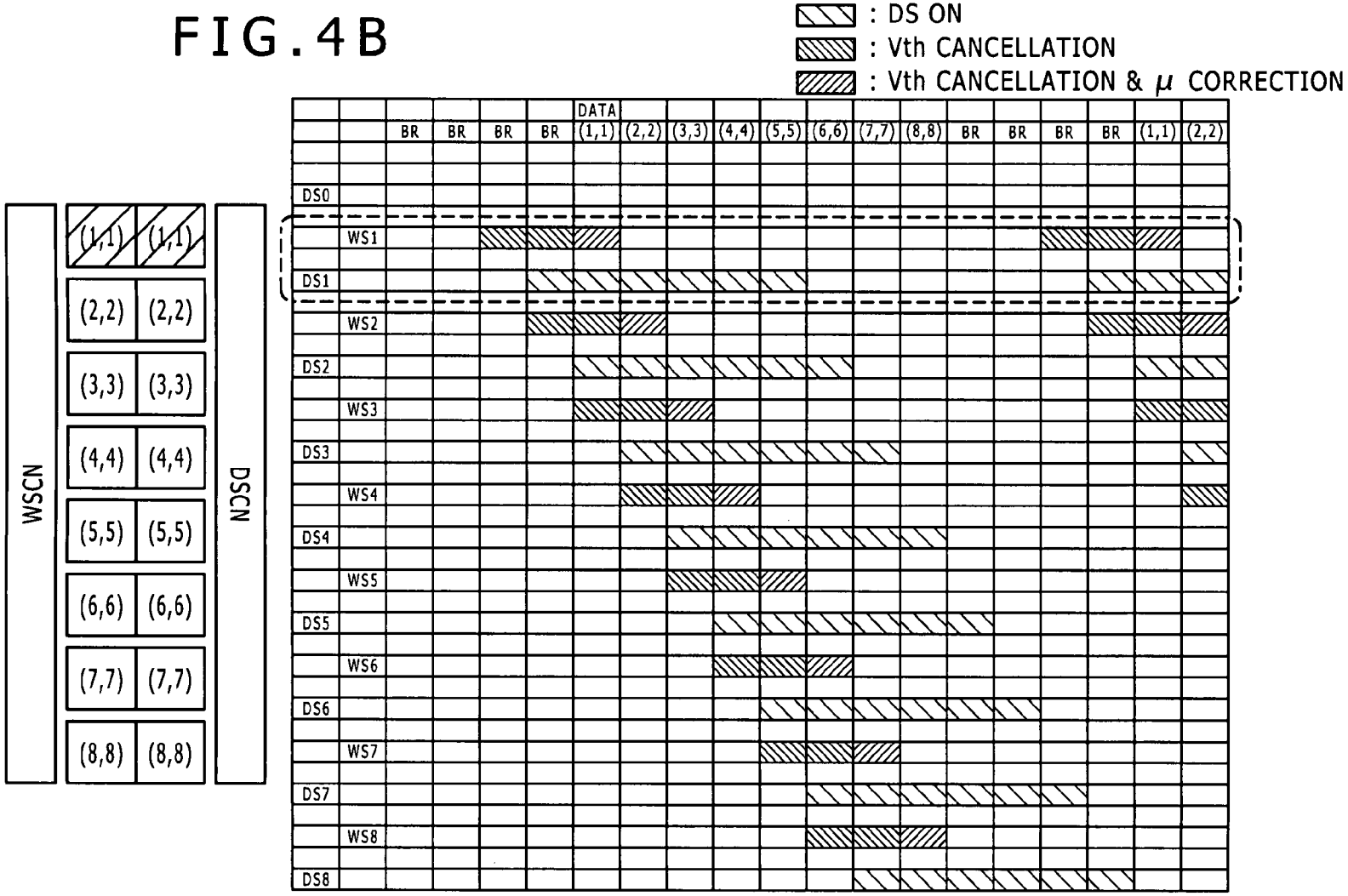
FIG. 4B is similarly a block chart of the reference example.

FIG. 4B is a block chart showing an active state of the first horizontal line of the display device according to the reference example. As shown in FIG. 4B, the pixel row of the first line is set in an active state by the first output WS1 of the first vertical driving circuit and the second output DS1 of the second vertical driving circuit, performs the series of operations, and emit light at a luminance corresponding to a video signal.

Figure 4C:
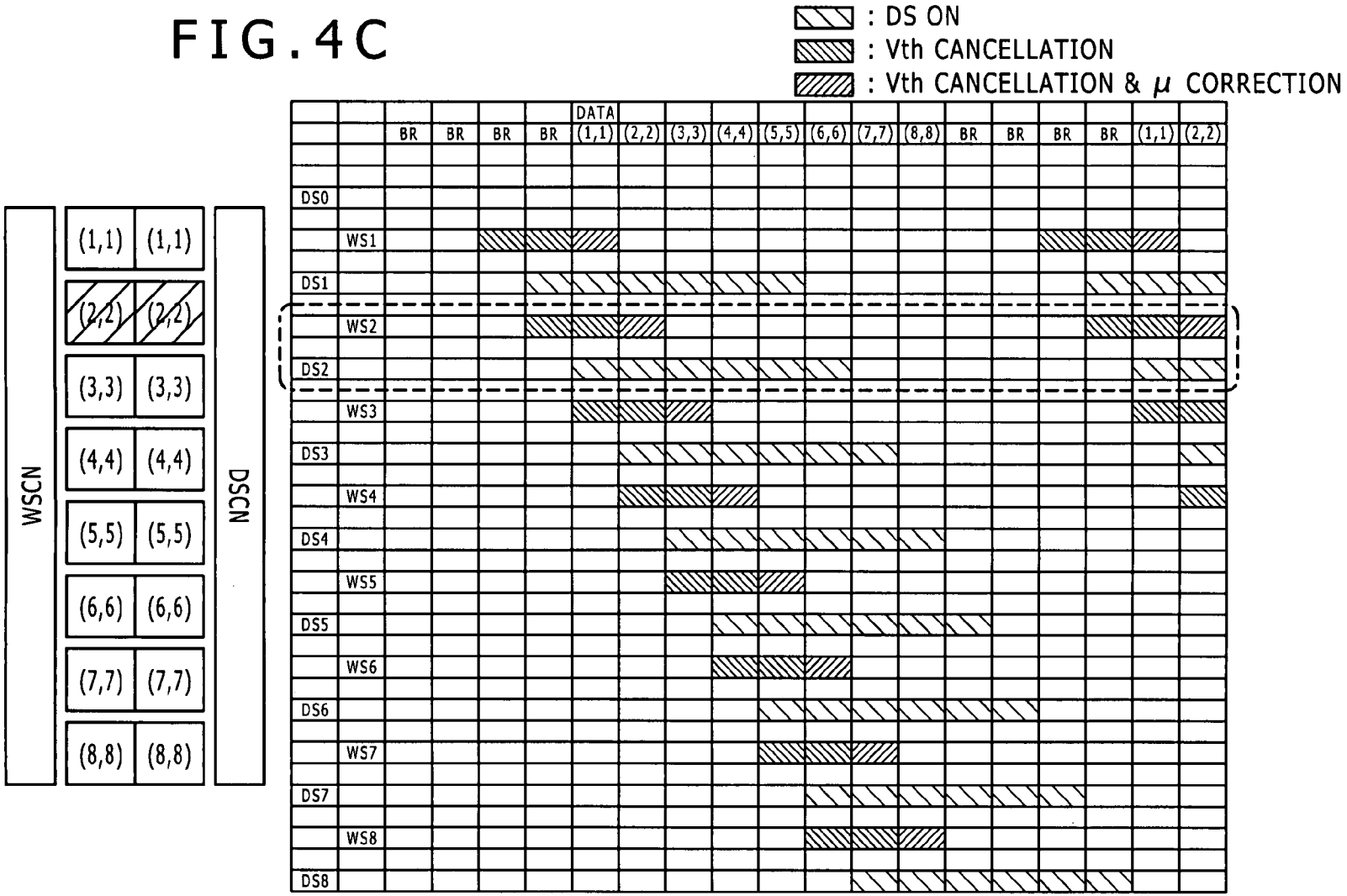
FIG. 4C is similarly a block chart of the reference example.
Figure 4D:
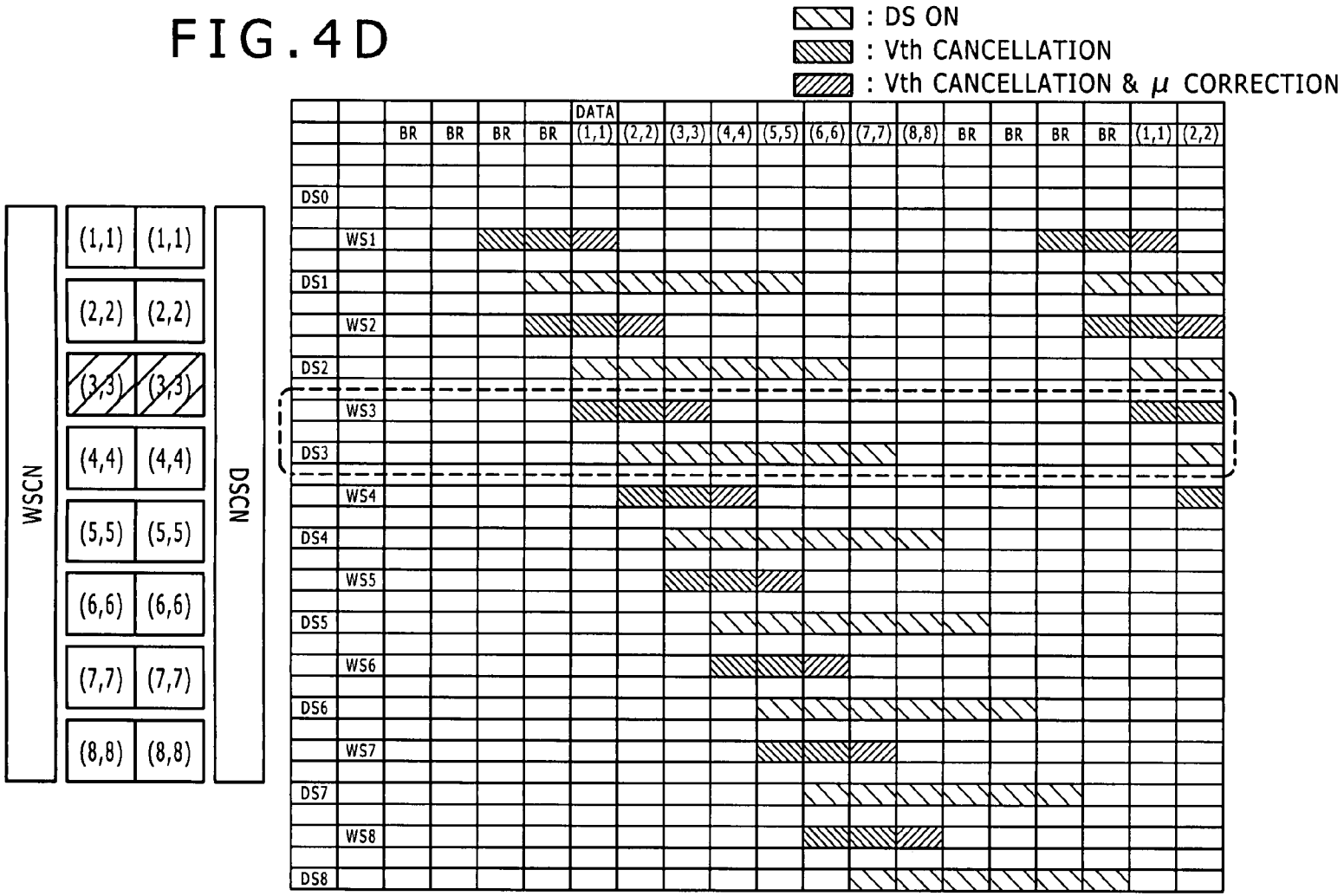
FIG. 4D is similarly a block chart of the reference example.

FIG. 4C is a block chart similarly showing a selected state of the second line of the display device according to the reference example. The outputs WS2 and DS2 are supplied to the pixels of the second line with a phase shifted by one H from a start of the operation for the first line. In response to the outputs WS2 and DS2, the pixels of the second line perform predetermined operation, and emit light at a luminance corresponding to a video signal.

FIG. 4A is a block chart similarly showing a selected state (active state) of the third line of the display device according to the reference example. The outputs WS3 and DS3 are supplied to the pixels of the third line with a phase shifted by one H from a start of the operation of the pixels in the second line. In response to the outputs WS3 and DS3, the pixels of the third line perform predetermined operation, and emit light at a luminance corresponding to a video signal. The predetermined operation includes the Vth cancelling operation, the signal writing operation, the mobility correcting operation, lighting operation, and the like.

Figure 5A:
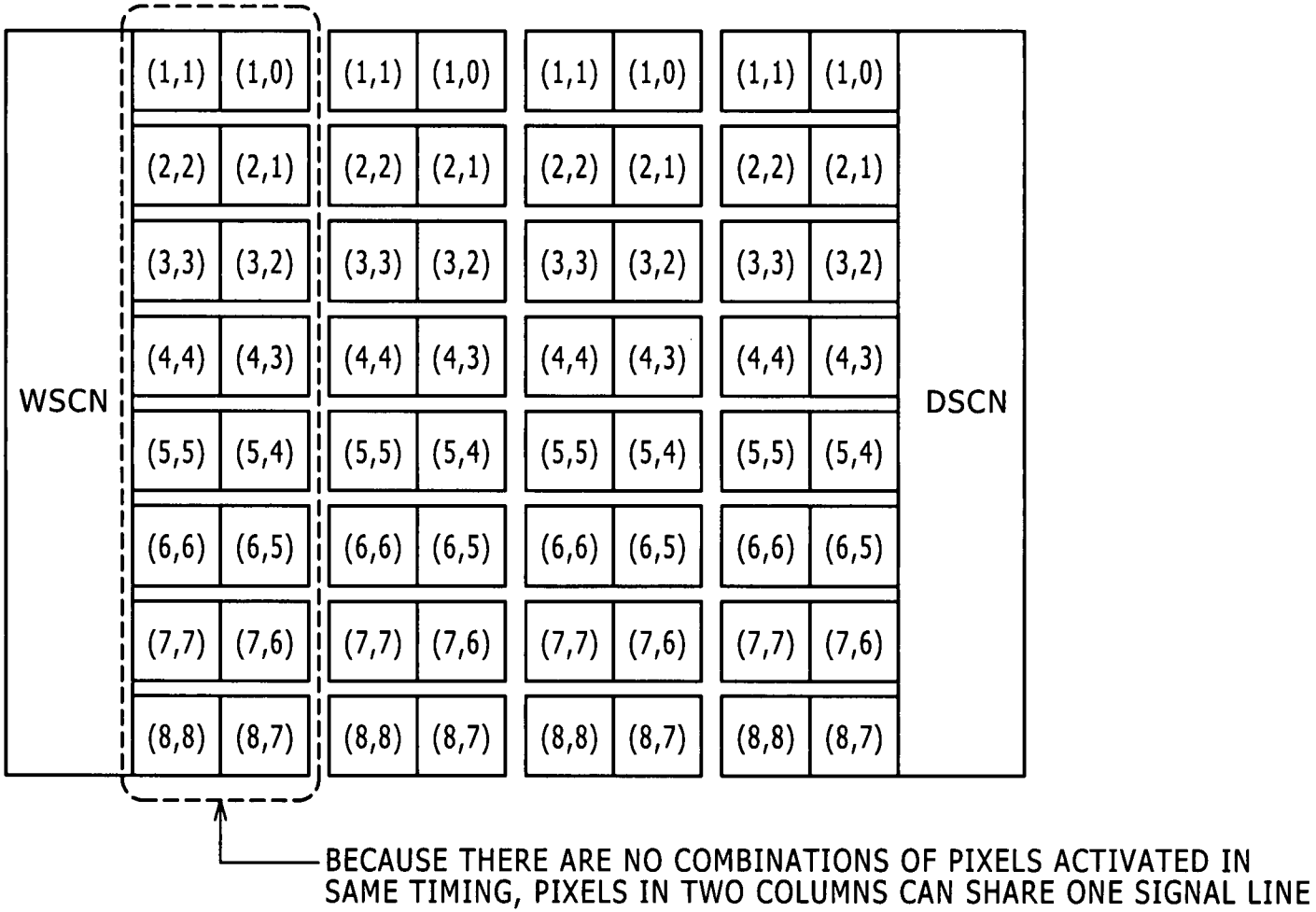
FIG. 5A is a schematic diagram of an operating system of a display device according to an embodiment of the present invention.

FIG. 5A is a schematic diagram of driving principles of a display device according to an embodiment of the present invention. A similar notation to that of FIG. 3A illustrating the driving system of the display device according to the reference example is adopted to facilitate understanding. As shown in FIG. 5A, a set of pixels of eight rows and eight columns is driven by a first vertical driving circuit WSCN and a second vertical driving circuit DSCN. Directing attention to the pixel row of a first line, pixels (1, 1) activated by the first output of the first vertical driving circuit WSCN and the first output of the second vertical driving circuit DSCN and pixels (1, 0) activated by the first output of the first vertical driving circuit WSCN and the zeroth output of the second vertical driving circuit DSCN are mixed with each other. Directing attention to a left pixel and a right pixel adjacent to each other in particular, the pixel (1, 1) is on the left side, and the pixel (1, 0) is on the right side. The timing of thus activating the left pixel and the timing of thus activating the right pixel are shifted from each other.

Similarly directing attention to the pixel row of a second line, timings of activating pixels adjacent to each other are shifted from each other. Directing attention to the pixels in the first column and the second column enclosed by a dotted line, for example, the pixel on the left side is (2, 2), and the pixel on the right side is (2, 1), and thus timings of operation of the pixels are shifted from each other. Thus, directing attention to the pixels in the two left and right columns, there is no combination of pixels activated in same timing of operation, and therefore one signal line can be shared between the left and right pixel columns. Thus, the total number of signal lines of the display device according to the embodiment of the present invention can be reduced to half of the total number of pixel columns.

Figure 5B:
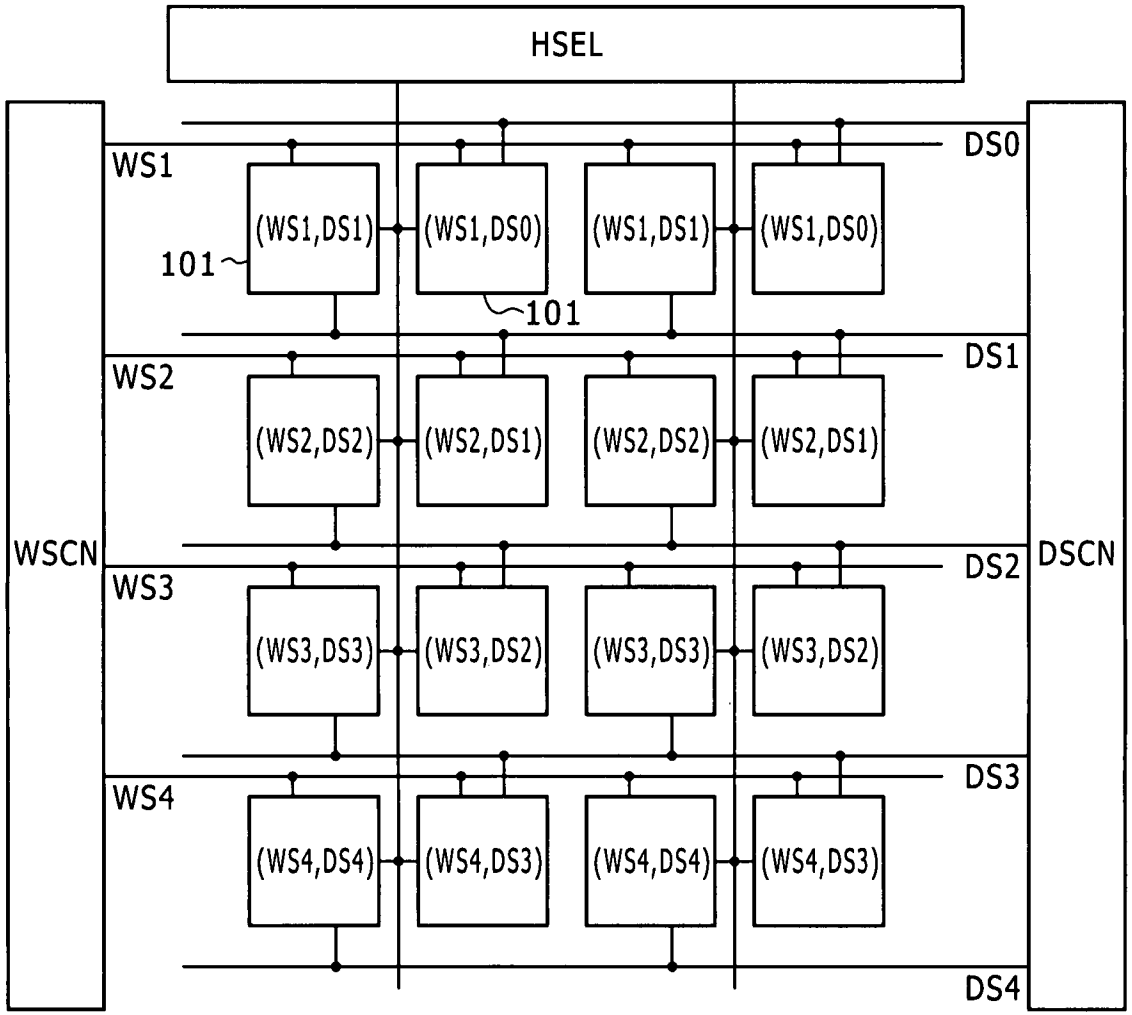
FIG. 5B is a diagram of wiring of the display device according to the embodiment of the present invention.

FIG. 5B is a circuit block diagram showing a concrete configuration of the display device according to the embodiment of the present invention which display device is shown in FIG. 5A. In order to facilitate understanding, parts corresponding to those of the display device according to the reference example shown in FIG. 3B are identified by corresponding reference numerals. The display device basically includes a pixel array section and a driving section enclosing the pixel array section in the form of a frame. The pixel array section includes a set of pixels 101 arranged in the form of a matrix. The driving section drives the pixel array section. The central pixel array section and the peripheral driving section enclosing the pixel array section are preferably formed in an integrated manner on one panel.

The pixel array section has signal lines in the form of columns arranged at a ratio of one signal line to two pixel columns, first driving lines WS in the form of rows arranged at a ratio of one first driving line WS to one pixel row, and second driving lines DS in the form of rows similarly arranged at a ratio of one second driving line DS to one pixel row. A signal line is commonly connected to the pixels 101 of the corresponding pair of a left column and a right column. A first driving line WS is connected to the pixels of the corresponding row. On the other hand, a second driving line DS is alternately connected to pixels in an upper row and pixels in a lower row with the second driving line DS between the upper row and the lower row.

The driving section includes: a horizontal driving circuit HSEL for supplying a video signal to the signal lines in the form of columns; a first vertical driving circuit WSCN for sequentially supplying a first driving signal to the first driving lines WS in the form of rows; and a second vertical driving circuit DSCN for supplying a second driving signal to the second driving lines DS in the form of rows. Each pixel 101 is set in an active state by the first driving signal and the second driving signal, and performs an operation of emitting light at a luminance corresponding to the video signal, whereby an image of one frame is displayed on the pixel array section.

Directing attention to the pixels of the first row, the four pixels are each connected to the first output WS1 of the first vertical driving circuit WSCN. Directing attention to the pixels of the second row, the four pixels are each connected to the corresponding second output WS2. The outputs WS of the first vertical driving circuit WSCN are in one-to-one correspondence with the pixel rows of the respective horizontal lines.

On the other hand, directing attention to the outputs of the second vertical driving circuit DSCN, the first output DS1 is alternately supplied to pixels adjacent to each other in an upper row and a lower row. The first output DS1 is supplied to the first and third pixels in the upper pixel row, and is also supplied to the even-numbered pixels in the second pixel row. The outputs DS of the second vertical driving circuit DSCN are thus alternately distributed to the odd-numbered pixels and the even-numbered pixels in the upper and lower pixel rows adjacent to each other. Hence, directing attention to the second pixel row, for example, pixels (WS2, DS2) activated by the outputs WS2 and DS2 and pixels (WS2, DS1) activated by the outputs WS2 and DS1 are alternately mixed with each other. A left pixel and a right pixel adjacent to each other are activated in respective timings different from each other, and are therefore able to share a signal line.

In order to drive the display device having such a configuration, scanning is performed twice with one frame period divided into a first field and a second field, whereby a video signal supplied from one signal line is distributed to different pixels in the first field and the second field. Specifically, the driving section scans each pixel row once in the first field period, and scans each pixel row once again in the second field period, whereby an image of one frame is displayed on the pixel array section. In the first field period, the first vertical driving circuit WSCN sequentially scans and supplies a first driving signal to the first driving lines WS row by row, while the second vertical driving circuit DSCN selectively scans and supplies a second driving signal to one of a group of the odd-numbered second driving lines DS1 and DS3 and a group of the even-numbered second driving lines DS0, DS2, and DS4. Thereby half of the pixels included in a pair of a left column and a right column commonly connected to each signal line are made to emit light. In the second field period, the first vertical driving circuit WSCN sequentially scans and supplies the first driving signal again to the first driving lines WS row by row, while the second vertical driving circuit DSCN selectively scans and supplies the second driving signal to the other of the group of the odd-numbered second driving lines DS1 and DS3 and the group of the even-numbered second driving lines DS0, DS2, and DS4. Thereby the other half of the pixels included in the pair of the left column and the right column commonly connected to each signal line are made to emit light.

Each pixel 101 has a circuit configuration shown in FIG. 1B, for example. Each pixel 101 includes at least a sampling transistor 3A, a driving transistor 3B, a storage capacitor 3C, and a light emitting element 3D. The control terminal of the sampling transistor 3A is connected to a scanning line WSL101 formed by one of a first driving line and a second driving line. The pair of current terminals of the sampling transistor 3A is connected to a signal line DTL101 and the control terminal of the driving transistor 3B. One of the pair of current terminals of the driving transistor 3B is connected to the light emitting element 3D, and the other of the pair of current terminals of the driving transistor 3B is connected to a feeding line DSL101 formed by the other of the first driving line and the second driving line. The storage capacitor 3C is connected between the control terminal and current terminal of the driving transistor 3B. Incidentally, in the present example, the first driving line side is the scanning line WSL101, and the second driving line side is the feeding line DSL101. However, the present invention is not limited to this, and this relation may be reversed.

In the pixel 101 of such a configuration, the sampling transistor 3A is turned on in response to a driving signal supplied from the scanning line WSL101 to sample a video signal from the signal line DTL101 and write the video signal to the storage capacitor 3C, and the driving transistor 3B operates in response to a driving signal supplied from the feeding line DSL101 to supply a driving current corresponding to the video signal written to the storage capacitor 3C to the light emitting element 3D.

The pixel 101 performs correcting operation according to the driving signals supplied from the scanning line WSL101 and the feeding line DSL101 before writing the video signal to the storage capacitor 3C. The pixel 101 thereby adds an amount of correction for cancelling a variation in threshold voltage of the driving transistor 3B to the storage capacitor 3C. The pixel 101 preferably repeats this threshold voltage correcting operation a plurality of times on a time division basis over a plurality of horizontal periods. In addition, the pixel 101 may subtract an amount of correction for cancelling a variation in mobility u of the driving transistor 3B from the storage capacitor 3C when writing the video signal to the storage capacitor 3C.

Figure 6A:
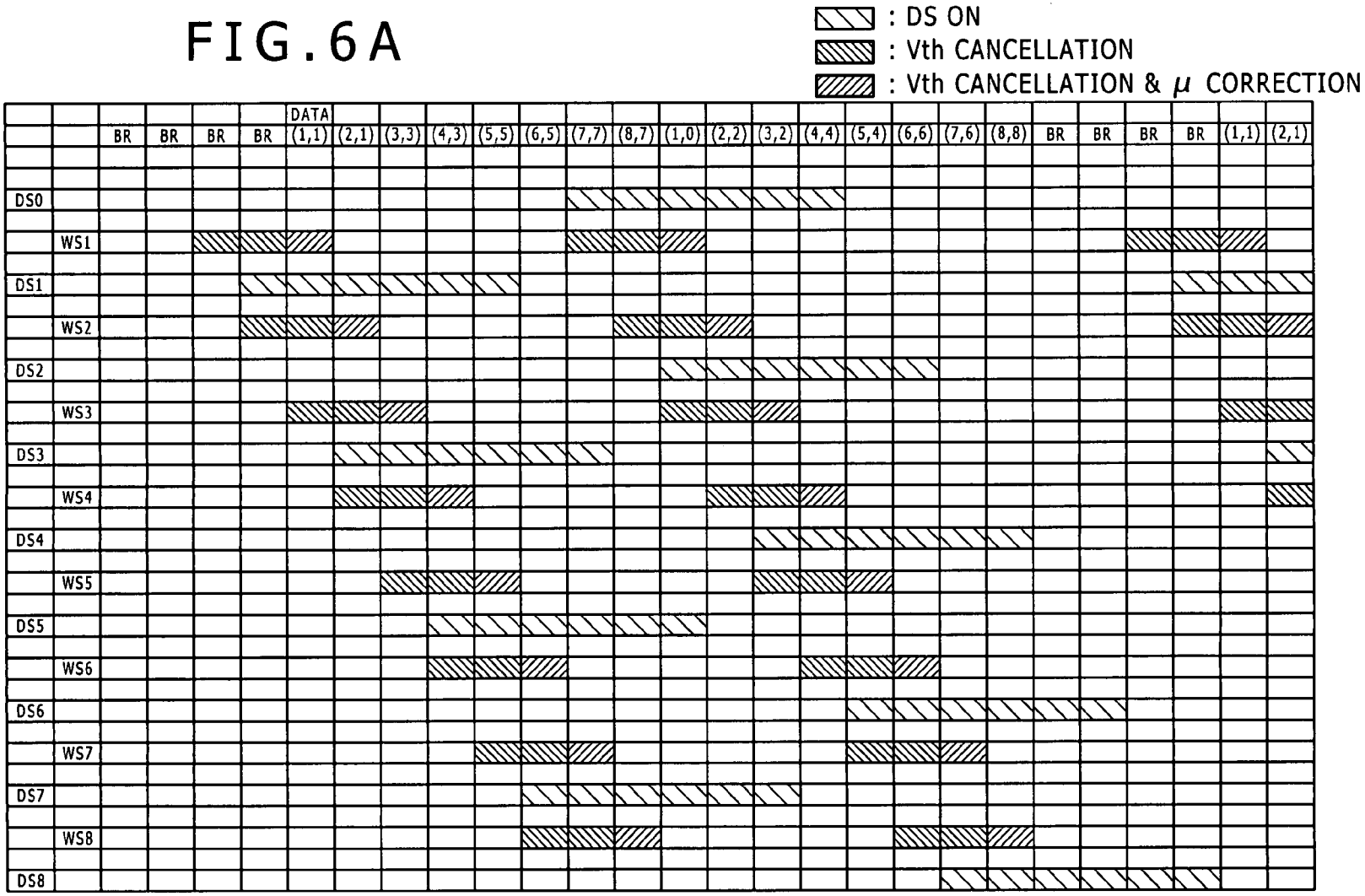
FIG. 6A is a block chart showing an operation sequence of the display device according to the embodiment of the present invention.

FIG. 6A is a block chart showing an operation sequence for one frame of the display device according to the embodiment of the present invention shown in FIG. 5A. A similar notation to that of the block chart of the display device according to the reference example shown in FIG. 4A is adopted to facilitate understanding. As shown in FIG. 6A, in the display device according to the embodiment of the present invention, one frame period is inserted between a preceding blanking period BR and a succeeding blanking period BR. One frame period is divided into a first field period and a second field period. In the first field period, the first driving lines are subjected to line-sequential scanning, and outputs WS1 to WS8 are sequentially supplied to the corresponding first driving lines. On the other hand, only odd-numbered second driving lines are selected and scanned, and only outputs DS1, DS3, DS5, and DS7 are output to the corresponding second driving lines.

When the second field period begins, the first driving lines are subjected to line-sequential scanning again, and outputs WS1 to WS8 are supplied to the corresponding first driving lines. On the other hand, only even-numbered second driving lines are selected and scanned, and only outputs DS0, DS2, DS4, DS6, and DS8 are output to the corresponding second driving lines. Thus, an image of one frame is displayed on the pixel array section by the two times of field scanning.

Figure 6B:
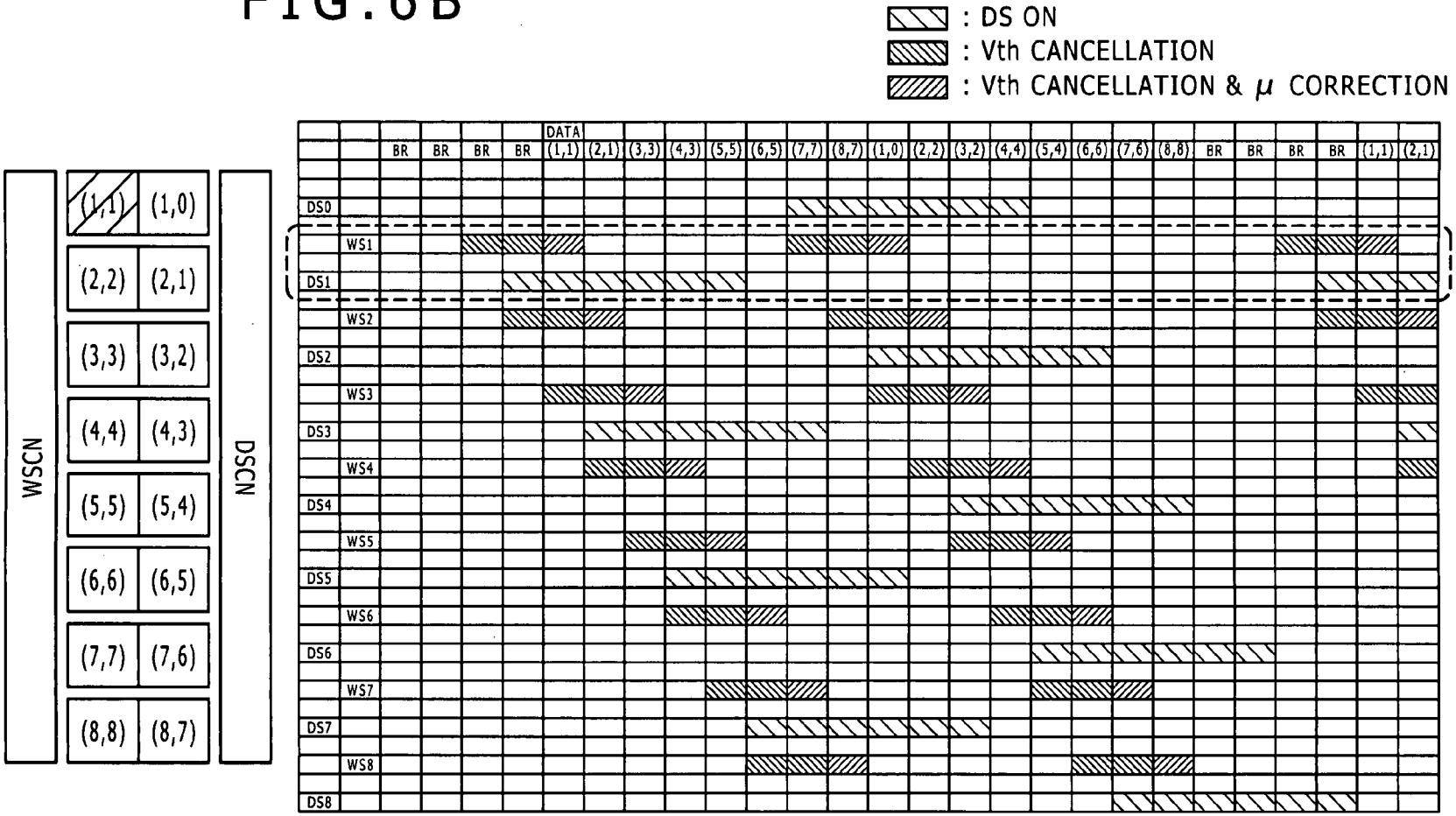
FIG. 6B is similarly a block chart showing the operation sequence of the display device according to the embodiment of the present invention.

FIG. 6B is a block chart showing a selected state of the pixel row of the first line of the display device according to the embodiment of the present invention. As shown in FIG. 6B, in the first horizontal period of the first field, the outputs WS1 and DS1 are output from the driving section side. Thereby, the pixels (1, 1) of the first line are set in an active state, while the pixels (1, 0) of the first line are set in an inactive state. The pixels (1, 1) set in the active state by the outputs WS1 and DS1 perform Vth cancelling operation on a time division basis over three horizontal periods (three Hs). In the third horizontal period of the three horizontal periods, the pixels perform signal writing operation and mobility correcting operation in addition to the Vth cancelling operation. The pixels further perform pixel lighting operation in response to the output DS1. The phases of the outputs WS1 and DS1 overlap each other over two horizontal periods. The Vth cancelling operation and the like are performed normally in the state of the phases of the outputs WS1 and DS1 overlapping each other. The phase relations between the outputs WS and DS at this time in the first field and in the second field are shifted by one H. In order to minimize the effect, the Vth cancelling operation is performed a plurality of times. Because the phases of the outputs WS and DS in the first field and the second field are shifted from each other by one H, the number of Vth cancelling operations is also effectively changed between the first field and the second field. The Vth cancelling operation is preferably repeated a large number of times so that the change does not affect picture quality.

The pixels can illuminate for a maximum of one field period, depending on the outputs DS. The pixels that have illuminated in the first field period do not illuminate in the second field period. Thus, the illumination time of a pixel in one frame period is one field period at a maximum, and therefore a light emission duty is 50% at a maximum.

Figure 6C:
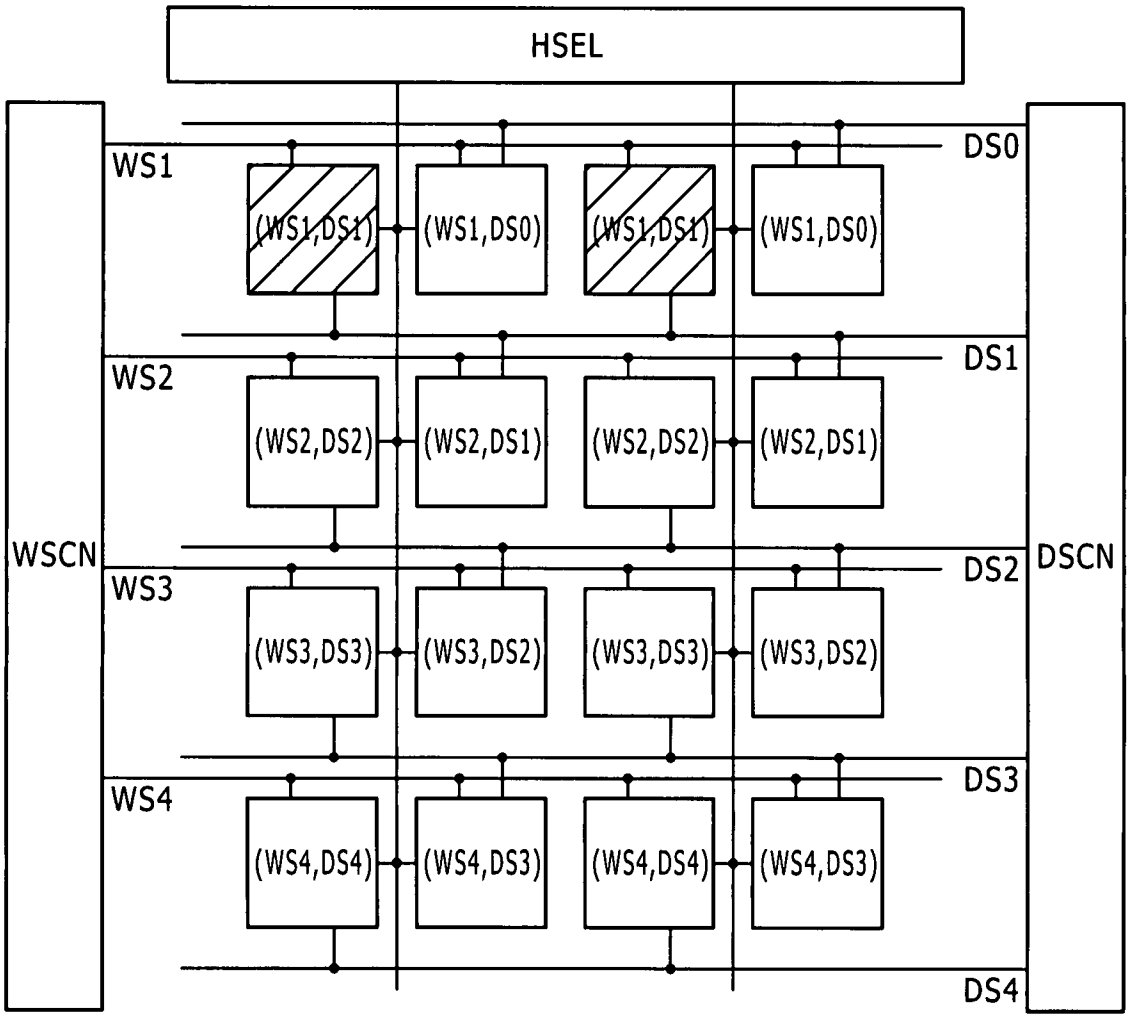
FIG. 6C is a diagram similarly of assistance in explaining the operation of the display device according to the embodiment of the present invention.

FIG. 6C is a block diagram showing pixels set in an active state in the block chart of FIG. 6B. As shown in FIG. 6C, when the outputs WS1 and DS1 are output from the driving section side, only hatched odd-numbered pixels (WS1, DS1) in the pixel row of the first line are activated and set in a light emitting state. On the other hand, even-numbered pixels (WS1, DS0) are set in an inactive state, and do not emit light. Therefore, the left and right pixels (WS1, DS1) and (WS1, DS0) are not activated in the same timing and are thus able to share a signal line.

Figure 6D:
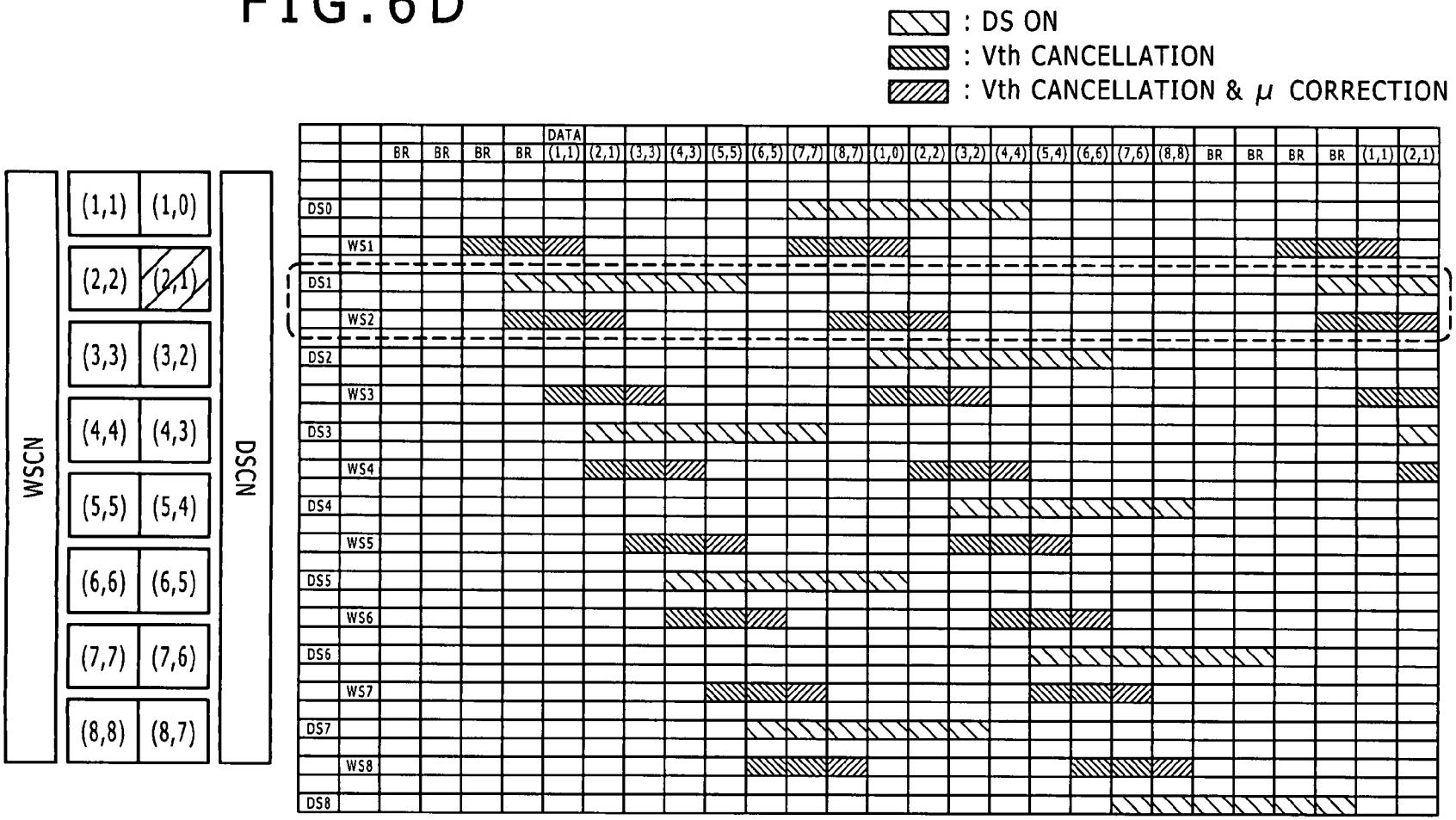
FIG. 6D is a block chart of the embodiment of the present invention.

FIG. 6D is a block chart when the phase has advanced by one H in the first field. As shown in FIG. 6D, the outputs DS1 and WS2 are output from the driving section side to the pixels of the second line.

Figure 6E:
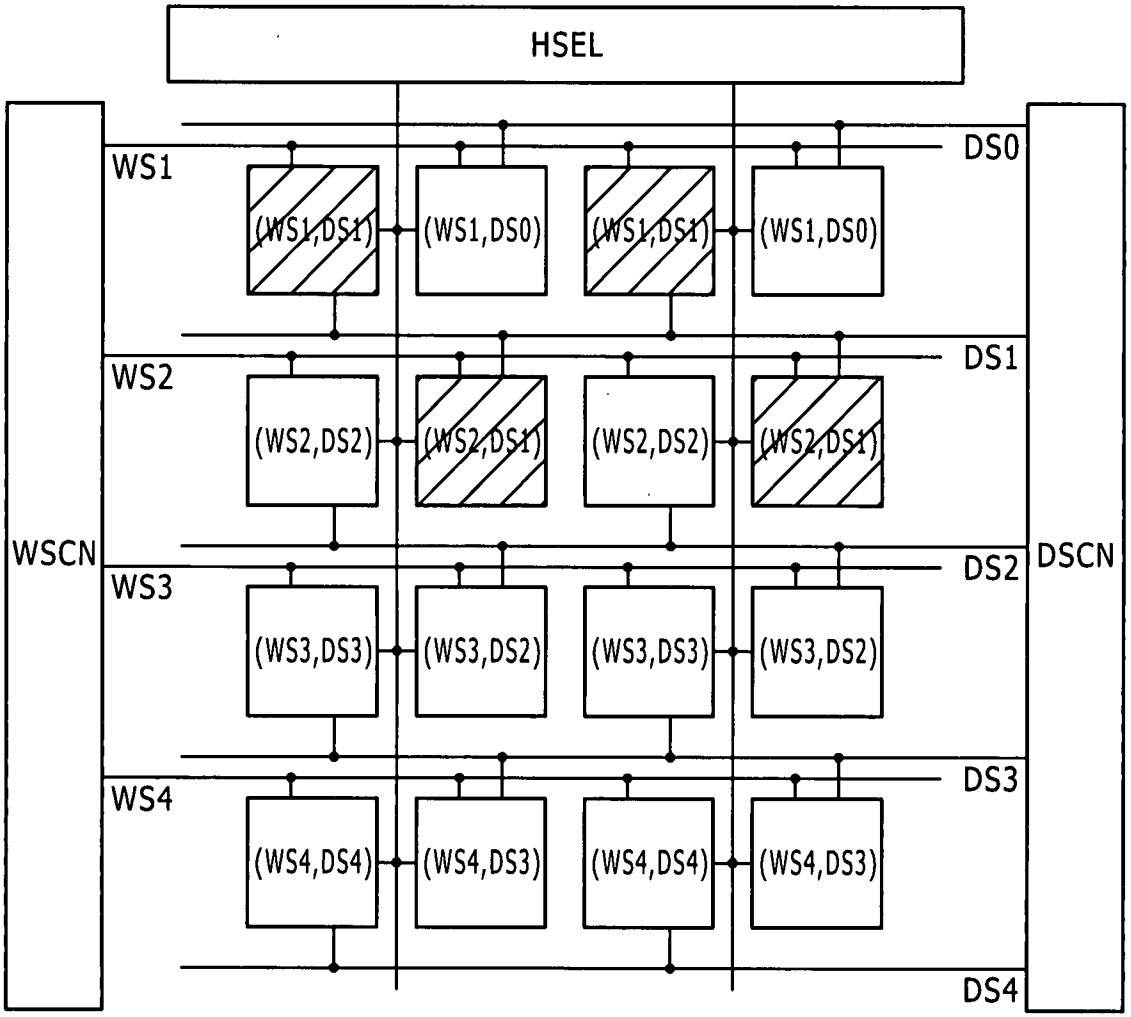
FIG. 6E is a diagram of assistance in explaining the operation of the embodiment of the present invention.

FIG. 6E is a block diagram showing the pixels set in an active state in the second line. As shown in FIG. 6E, the even-numbered pixels (WS2, DS1) in the second line are activated in response to the outputs WS2 and DS1, and then make a transition to a light emitting state as shown by hatching. On the other hand, the odd-numbered pixels (WS2, DS2) are set in a non-selected state. Incidentally, the pixels (WS1, DS1) that continue being in the light emitting state in the first line are also shown hatched.

Figure 6F:
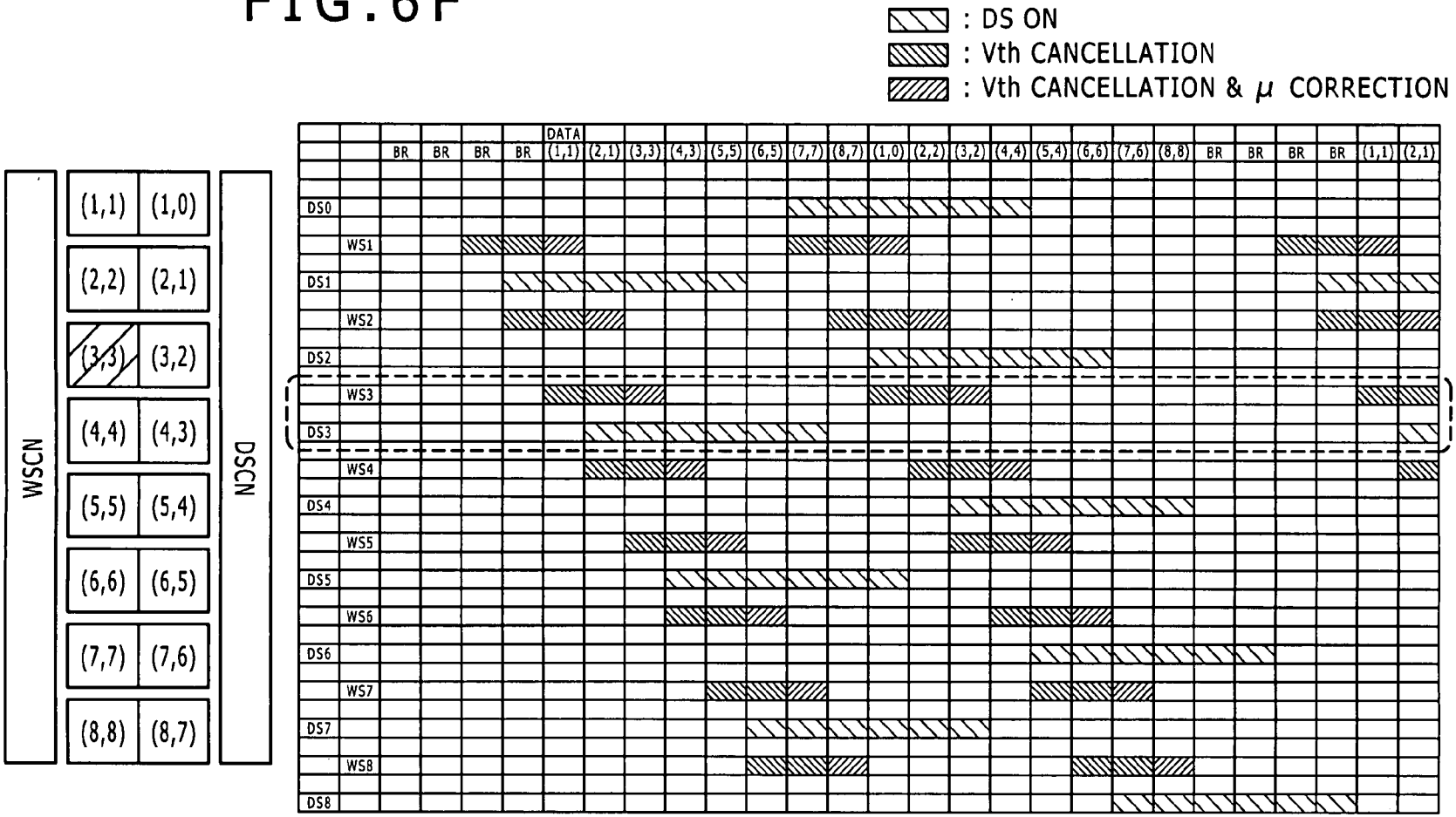
FIG. 6F is a block chart of the embodiment of the present invention.

FIG. 6F is a block chart when the operation sequence has further advanced by one H. At this point, the outputs WS3 and DS3 are output from the driving section side to the pixels of the third line in the first field.

Figure 6G:
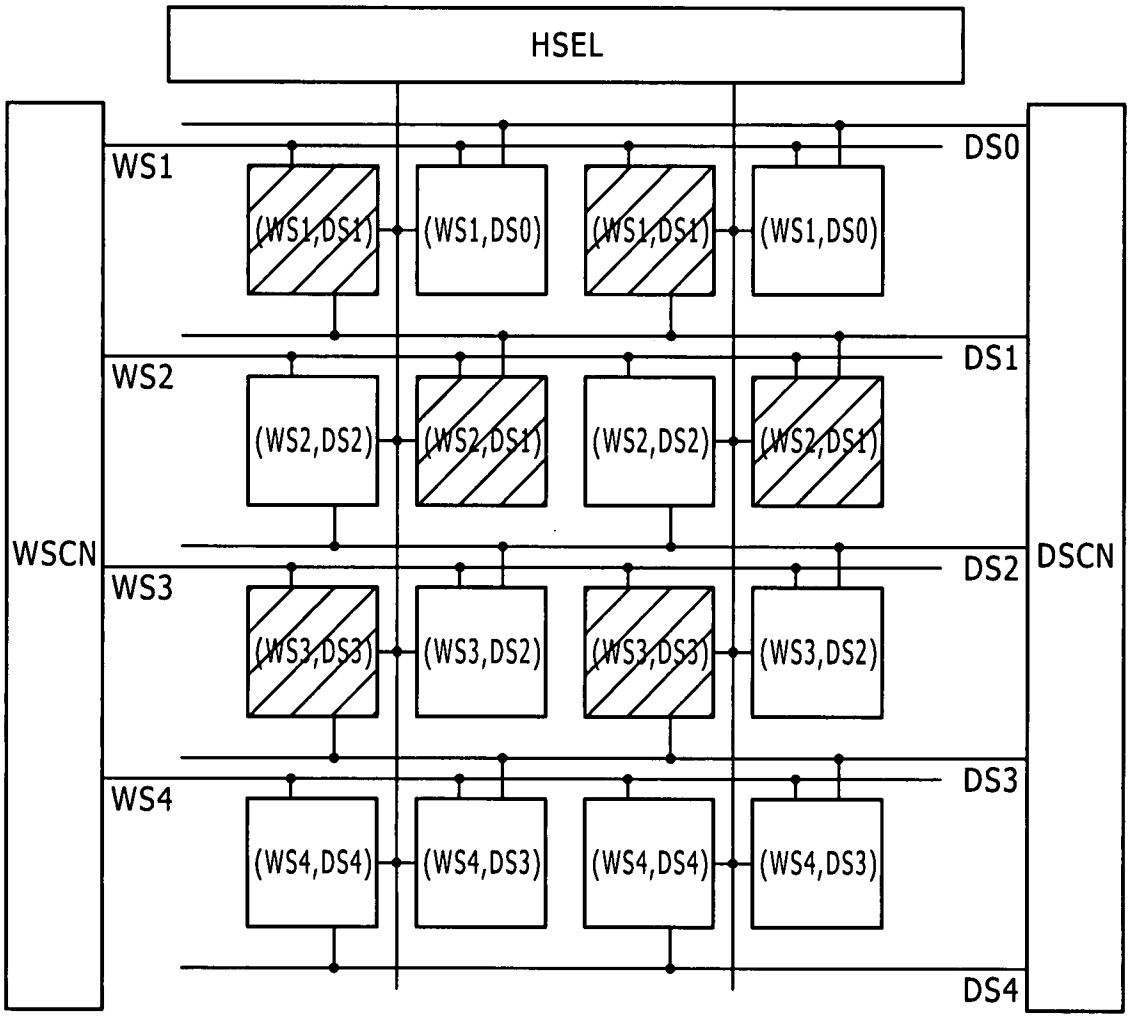
FIG. 6G is a diagram of assistance in explaining the operation of the embodiment of the present invention.

FIG. 6G corresponds to the block chart of FIG. 6F described above, and indicates pixels set in a selected state in the third line by hatching. As shown in FIG. 6G, in the third line, the odd-numbered pixels (WS3, DS3) come into a selected state in response to the outputs WS3 and DS3, while the even-numbered pixels (WS3, DS2) are set in a non-selected state. Hence, only the hatched odd-numbered pixels emit light.

Figure 6H:
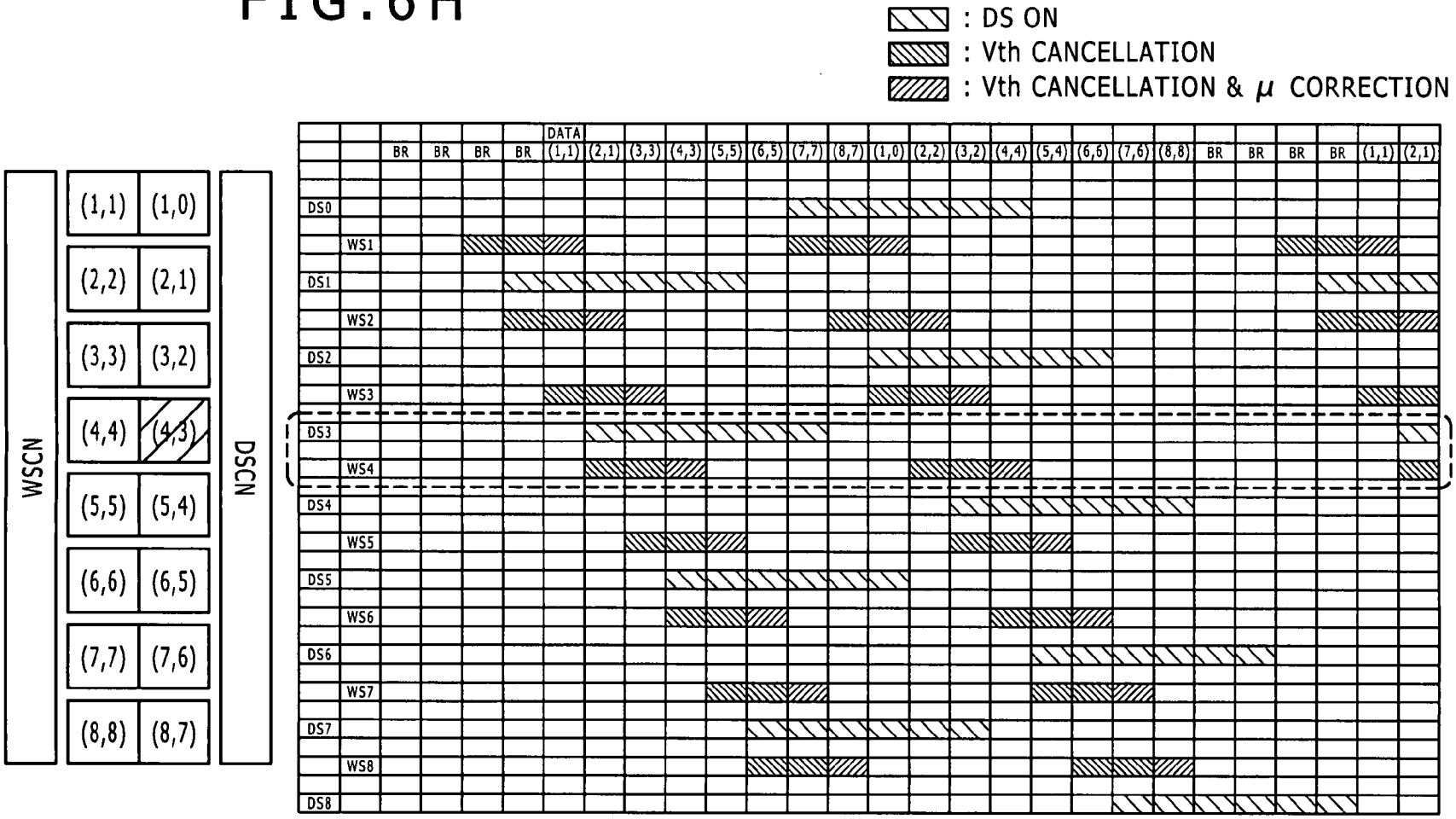
FIG. 6H is similarly a block chart showing the operation sequence of the display device according to the embodiment of the present invention.
Figure 61:
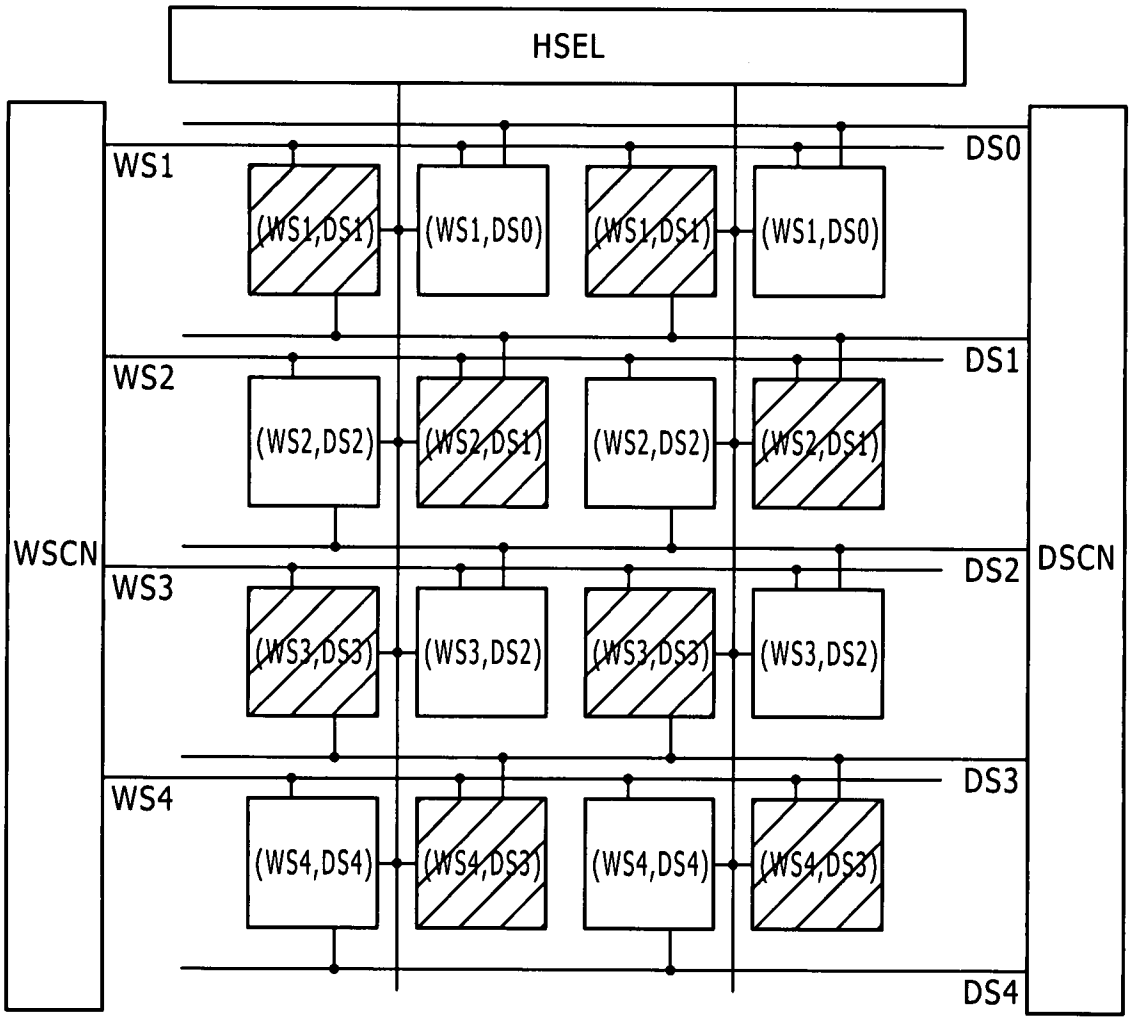

FIG. 6H is a block chart when the operation sequence has further advanced by one H. As shown in FIG. 6H, the outputs WS3 and DS4 are output from the driving section side to the pixels of the fourth line. As is clear from a comparison with the block chart of FIG. 6F for the third line, the phase relation between the outputs DS3 and WS4 in the fourth line is shifted by one H from the phase relation between the outputs DS3 and WS3 in the third line. In order to prevent this shift from adversely affecting the actual operation of the pixels, the Vth cancelling operation is performed a plurality of times on a time division basis.

FIG. 6I shows a selected state of a screen corresponding to the block chart of FIG. 6H. As shown in FIG. 6I, the even-numbered pixels (WS4, DS3) in the pixel row of the fourth line are set in a selected state, and emit light as shown by hatching. On the other hand, the odd-numbered pixels (WS4, DS4) are set in a non-selected state. Thus, in the first field, half of all the 16 pixels, that is, the 8 pixels are set in an active state, and emit light according to the video signal supplied from the respective signal lines. As shown in FIG. 6I, the selected pixels are situated in a zigzag manner on the pixel array section.

Thereafter the second field period begins. The sequential scanning of the pixel array section is performed again so that the pixels in the non-selected state which pixels remain in a zigzag manner are selected and made to emit light at a luminance corresponding to the video signal. When the first field and the second field are thus completed, an image of one frame is displayed on the pixel array section.

Figure 7A:
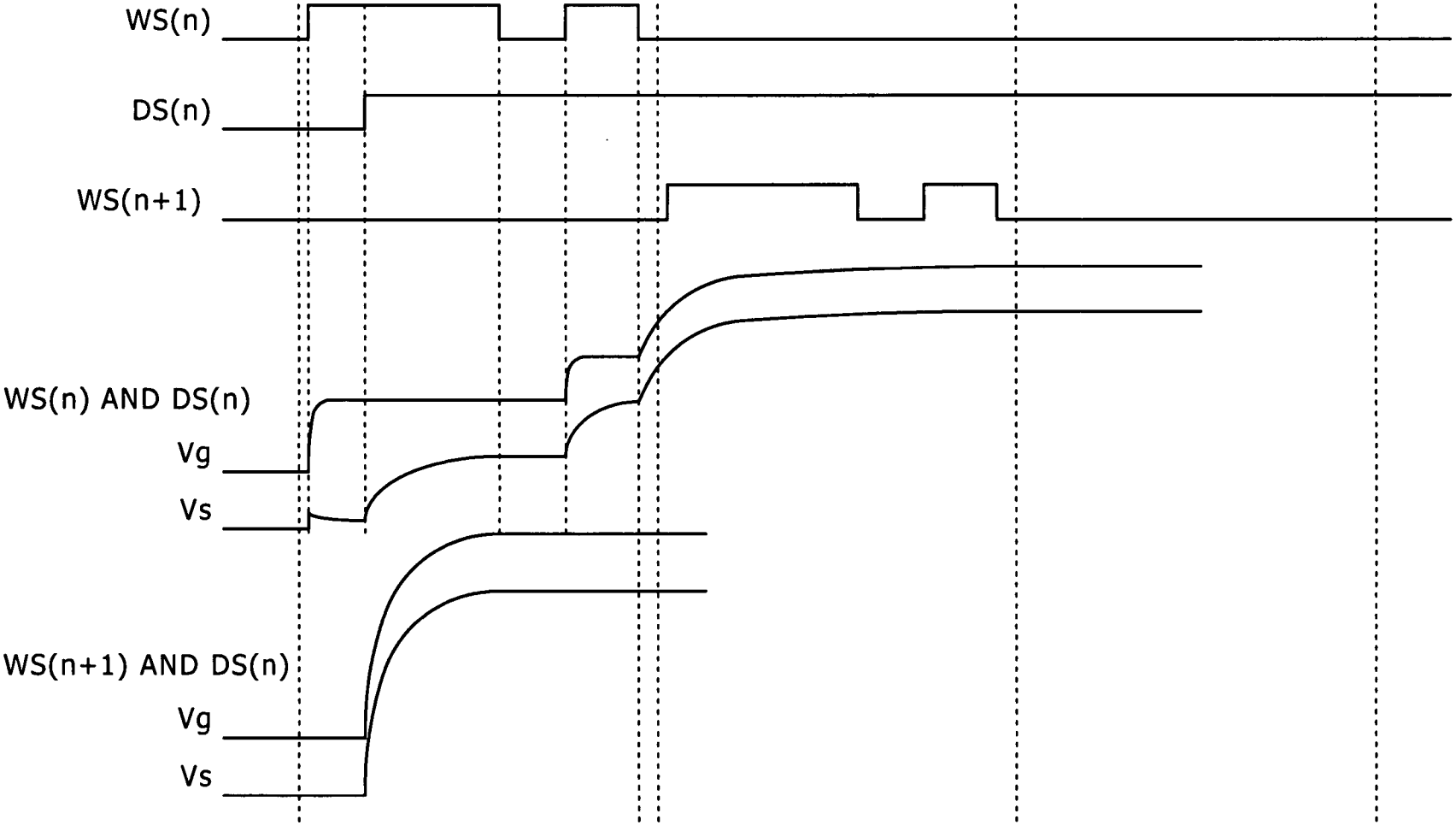
FIG. 7A is a timing chart of assistance in explaining the operation of the display device according to the reference example.

The Vth cancelling operation (threshold voltage correcting operation) may be performed only once, or may be repeated on a time division basis over a plurality of horizontal periods. FIG. 7A shows the gate potentials Vg and the source potentials Vs of driving transistors when the pixel configuration according to the embodiment of the present invention is used in a case where divided Vth cancellation is not performed. This figure includes results of the gate potentials Vg and the source potentials Vs of two pixels, one result being a result of the gate potential Vg and the source potential Vs of a driving transistor driven by outputs WS(n) and DS(n), and the other being a result of the gate potential Vg and the source potential Vs of a driving transistor driven by outputs WS(n+1) and DS(n). The former outputs indicate that initialization, Vth cancellation, and writing (and mobility correction) are performed normally, and that a desired light emission is obtained. In the case of the latter, on the other hand, the output DS is changed to the high potential Vcc_H before the output WS is turned on, so that the pixel returns to the gate potential Vg and the source potential Vs in the preceding field and momentarily emits light again (in the circuit of FIG. 1B, the feeding line DS is lowered to the low potential Vcc_L to change emission to non-emission, and therefore when the feeding line DS is returned to the high potential Vcc_H, light emission starts at a same gate-to-source voltage Vgs). This is not a desired operation, and is thus not preferable.

Figure 7B:
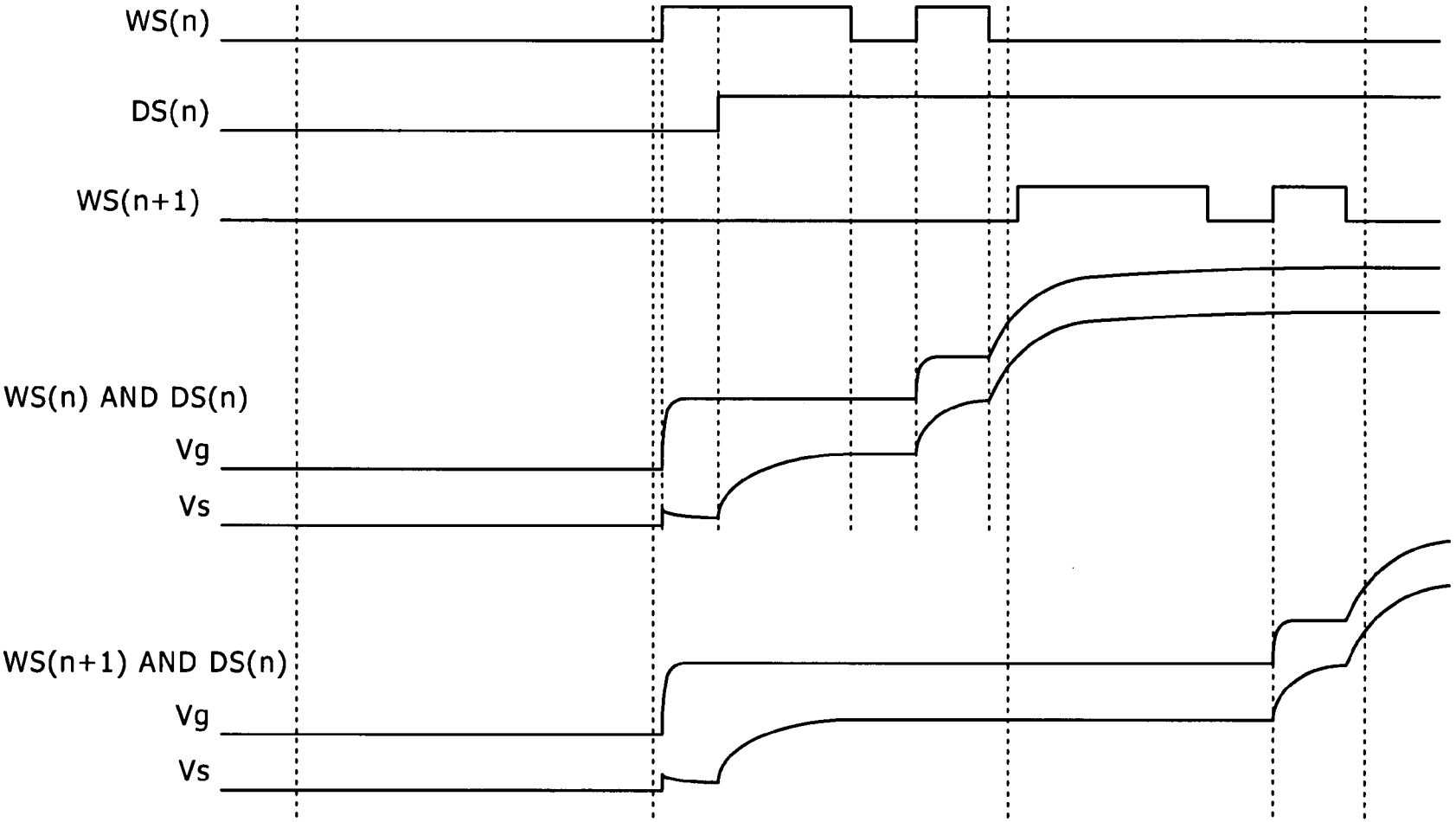
FIG. 7B is a timing chart of assistance in explaining the operation of the display device according to the embodiment of the present invention.

FIG. 7B shows the gate potentials Vg and the source potentials Vs of driving transistors when the pixel configuration according to the embodiment of the present invention is used in a case where divided Vth cancellation is performed. This figure similarly includes results of the gate potentials Vg and the source potentials Vs of two pixels. Unlike FIG. 7A, in either of combinations, the output WS is turned on first, so that initialization is performed normally and a desired light emission can be obtained in either of the combinations. As is understood from FIGS. 6A to 6G and FIG. 7B, when driving is performed with the pixel configuration according to the embodiment of the present invention, the number of divided Vth cancellations differs by one between pixel lines sharing an output. It is therefore important to apply sufficient Vth cancellation by increasing the number of divided Vth cancellations or lengthening the time of one Vth cancellation, for example. When the Vth cancellation is not performed sufficiently, light emission is expected to occur at a different luminance in each stage even with a same sampling potential.

Figure 7C:
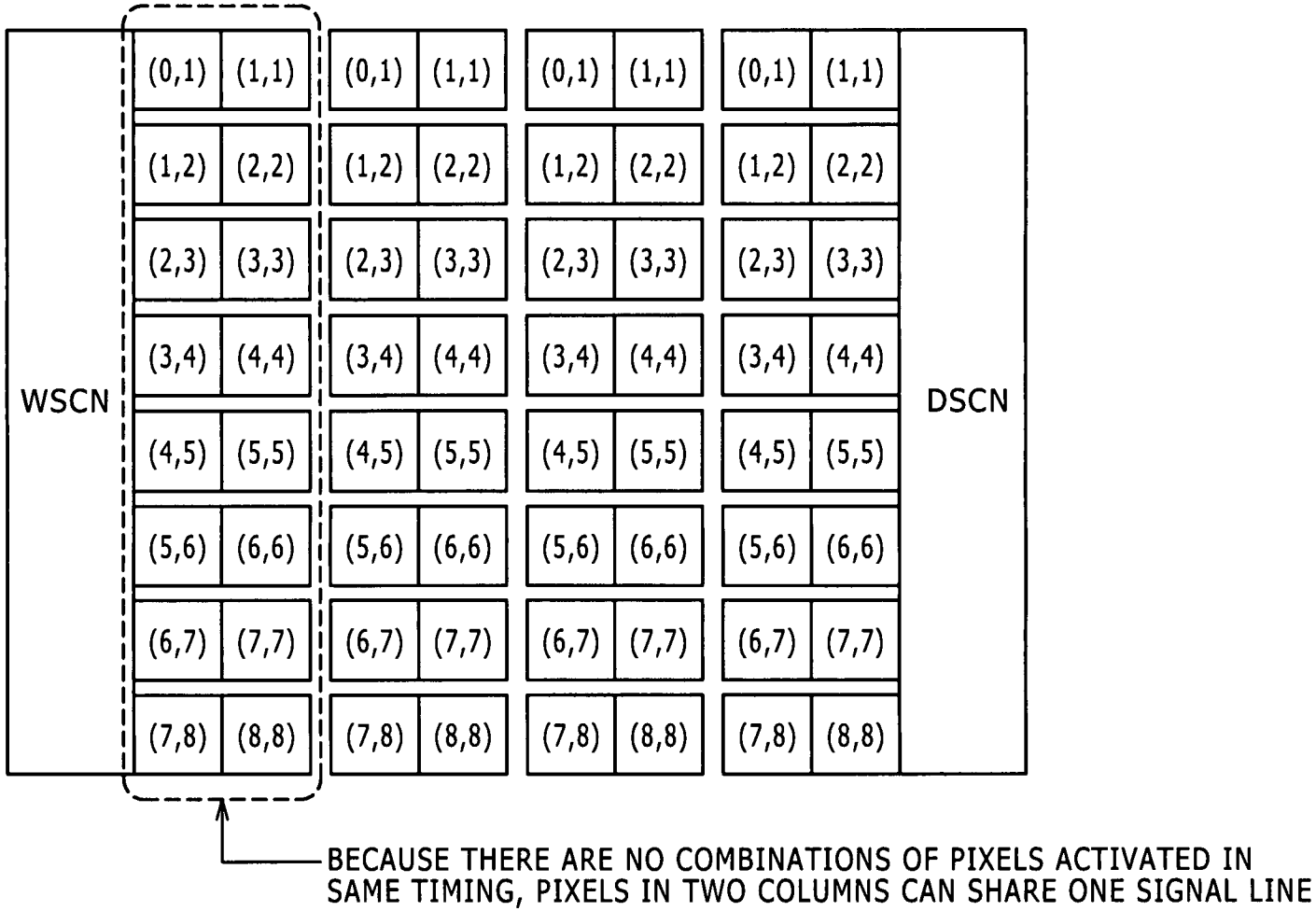
FIG. 7C is a schematic diagram representing a driving system of another embodiment of a display device according to the present invention.

Incidentally, in the foregoing embodiment, the first driving line side is the scanning lines WS, and the second driving line side is the feeding lines DS. However, the present invention is not limited to this, and this relation may be reversed. FIG. 7C is a schematic diagram of driving principles of such an embodiment. In order to facilitate understanding, a similar notation to that of FIG. 5A representing the operating principles of the foregoing embodiment is adopted. As shown in FIG. 7C, a set of pixels of eight rows and eight columns is driven by a vertical driving circuit WSCN and a vertical driving circuit DSCN. Directing attention to the pixel row of a first line, pixels (0, 1) activated by the zeroth output of the vertical driving circuit WSCN and the first output of the vertical driving circuit DSCN and pixels (1, 1) activated by the first output of the vertical driving circuit WSCN and the first output of the vertical driving circuit DSCN are mixed with each other. Directing attention to a left pixel and a right pixel adjacent to each other in particular, the pixel (0, 1) is on the left side, and the pixel (1, 1) is on the right side. The timing of thus activating the left pixel and the timing of thus activating the right pixel are shifted from each other.

Similarly directing attention to the pixel row of a second line, timings of activating pixels adjacent to each other are shifted from each other. Directing attention to the pixels in the first column and the second column enclosed by a dotted line, for example, the pixel on the left side is (1, 2), and the pixel on the right side is (2, 2), and thus timings of operation of the pixels are shifted from each other. Thus, directing attention to the pixels in the two left and right columns, there is no combination of pixels activated in same timing of operation, and therefore one signal line can be shared between the left and right pixel columns. Thus, the total number of signal lines of the display device according to the embodiment of the present invention can be reduced to half of the total number of pixel columns.

Figure 7D:
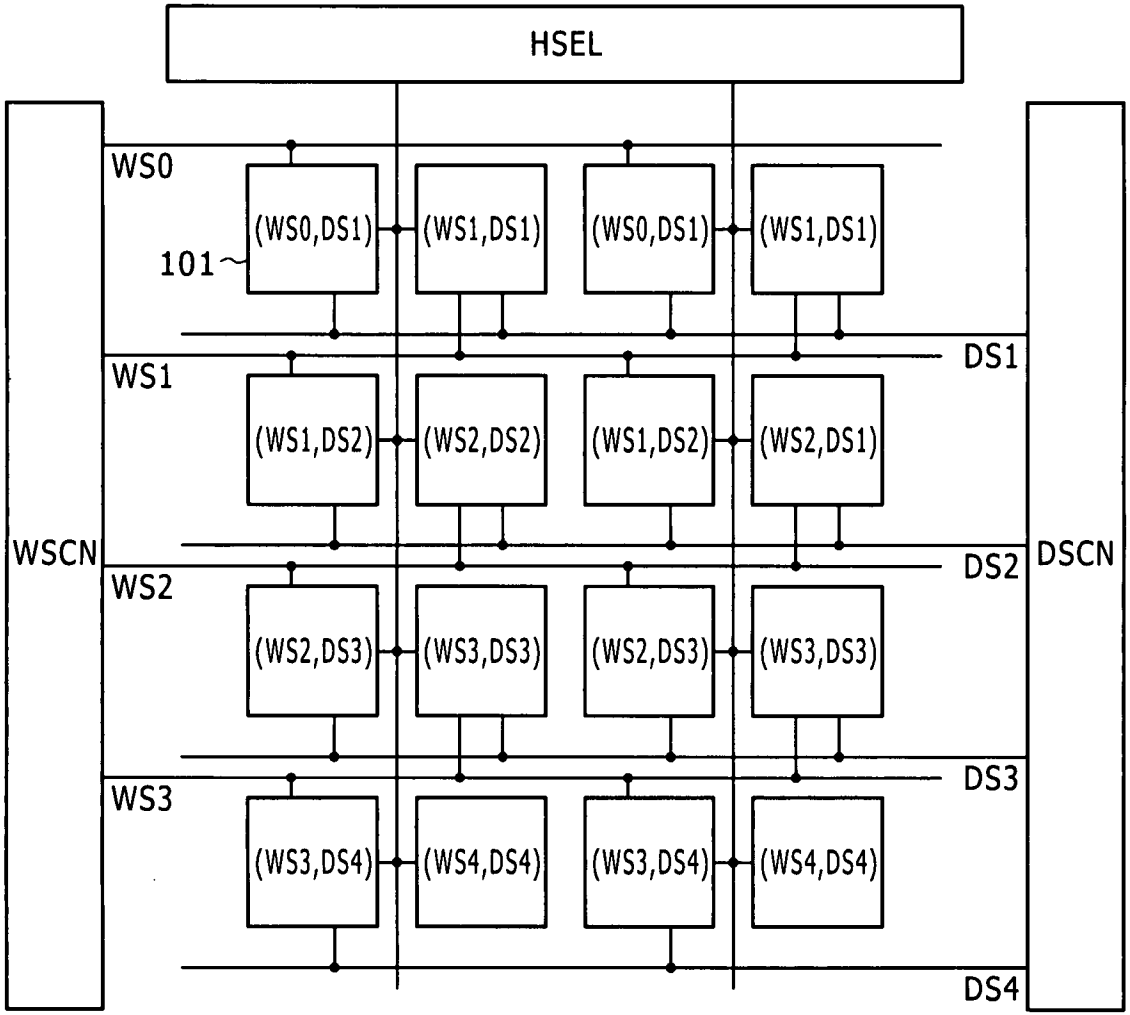
FIG. 7D is a diagram of wiring of the display device shown in FIG. 7C.

FIG. 7D is a circuit block diagram showing a concrete configuration of the display device according to the embodiment shown in FIG. 7C. In order to facilitate understanding, parts corresponding to those of the display device according to the foregoing embodiment shown in FIG. 5B are identified by corresponding reference numerals. The display device basically includes a pixel array section and a driving section enclosing the pixel array section in the form of a frame. The pixel array section includes a set of pixels 101 arranged in the form of a matrix. The driving section drives the pixel array section. The central pixel array section and the peripheral driving section enclosing the pixel array section are preferably formed in an integrated manner on one panel.

The pixel array section has signal lines in the form of columns arranged at a ratio of one signal line to two pixel columns, driving lines WS in the form of rows arranged at a ratio of one driving line WS to one pixel row, and driving lines DS in the form of rows similarly arranged at a ratio of one driving line DS to one pixel row. A signal line is commonly connected to the pixels 101 of the corresponding pair of a left column and a right column. A driving line DS is connected to the pixels of the corresponding row. On the other hand, a driving line WS is alternately connected to pixels in an upper row and pixels in a lower row with the driving line WS between the upper row and the lower row. That is, as compared with the foregoing embodiment, the connection relations of the driving lines WS and DS are interchanged.

The driving section includes: a horizontal driving circuit HSEL for supplying a video signal to the signal lines in the form of columns; a vertical driving circuit WSCN for supplying a driving signal to the driving lines WS in the form of rows; and a vertical driving circuit DSCN for supplying a driving signal to the driving lines DS in the form of rows. Each pixel 101 is set in an active state by these driving signals, and performs an operation of emitting light at a luminance corresponding to the video signal, whereby an image of one frame is displayed on the pixel array section.

Figure 7E:
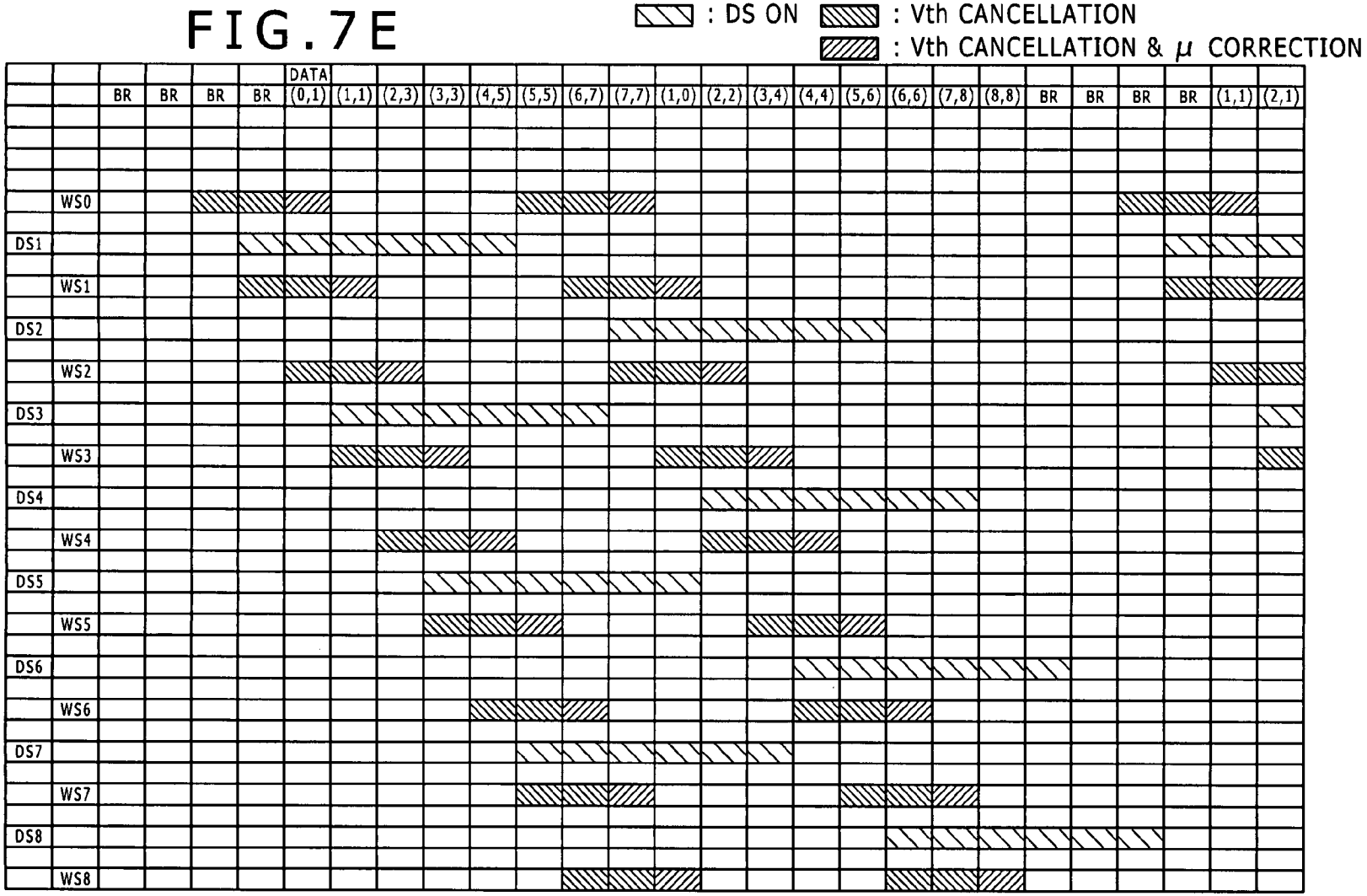
FIG. 7E is a block chart showing an operation sequence of the display device shown in FIG. 7C.

FIG. 7E is a block chart showing an operation sequence for one frame of the display device according to the embodiment of the present invention which display device is shown in FIG. 7C. A similar notation to that of the block chart of FIG. 6A of the display device according to the foregoing embodiment is adopted to facilitate understanding. As shown in FIG. 7E, in the display device according to the present embodiment, one frame period is inserted between a preceding blanking period BR and a succeeding blanking period BR. One frame period is divided into a first field period and a second field period. In the first field period, the driving lines WS are subjected to line-sequential scanning, and outputs WS0 to WS8 are sequentially supplied to the corresponding driving lines WS. On the other hand, only odd-numbered driving lines DS are selected and scanned, and only outputs DS1, DS3, DS5, and DS7 are output to the corresponding driving lines DS.

When the second field period begins, the driving lines WS are subjected to line-sequential scanning again, and outputs WS0 to WS8 are supplied to the corresponding driving lines WS. On the other hand, only even-numbered driving lines DS are selected and scanned, and only outputs DS0, DS2, DS4, DS6, and DS8 are output to the corresponding driving lines DS. Thus, an image of one frame is displayed on the pixel array section by the two times of field scanning.

Figure 7F:
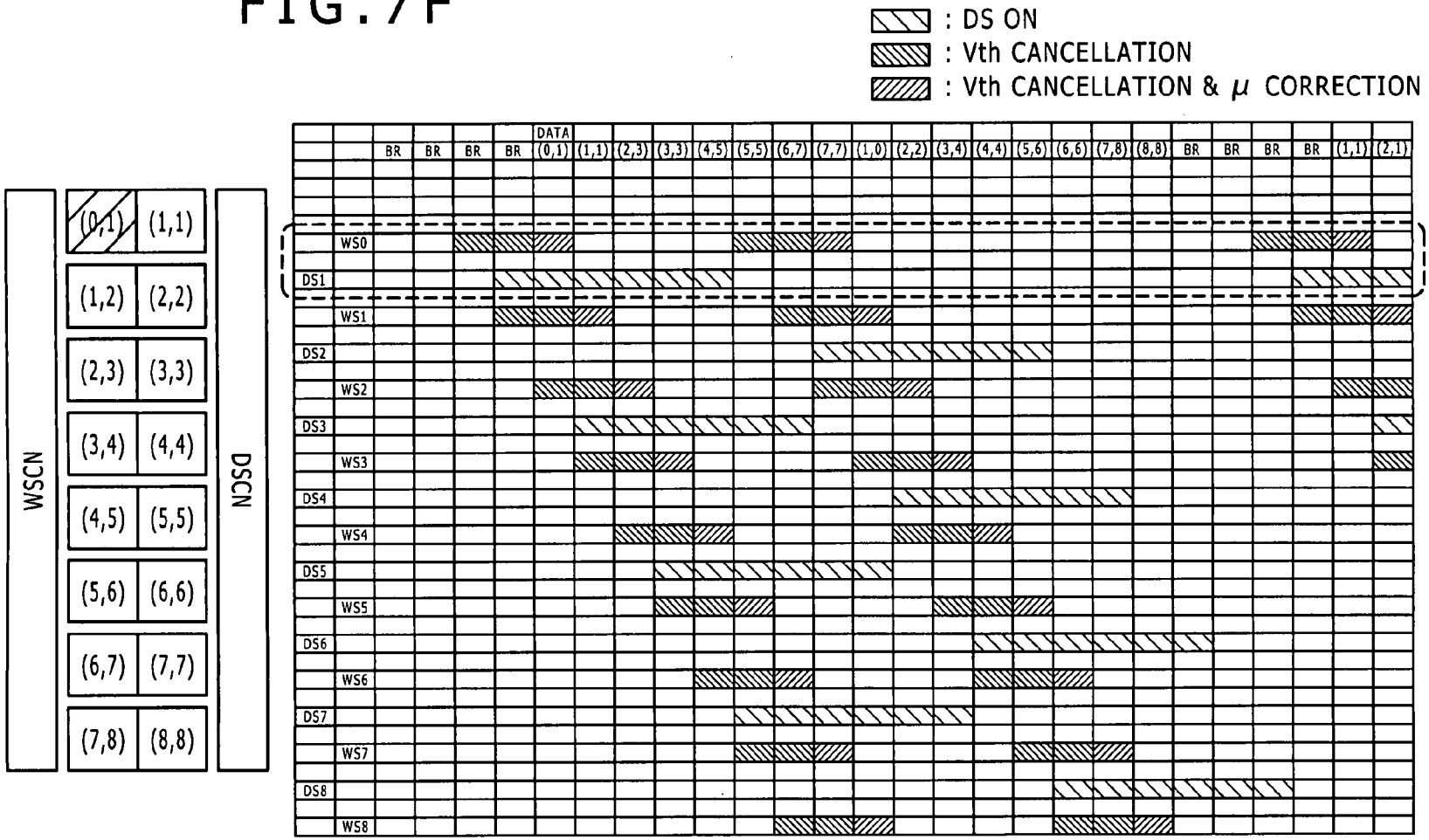
FIG. 7F is similarly a block chart showing the operation sequence of the display device shown in FIG. 7C.

FIG. 7F is a block chart showing a selected state of the pixel row of the first line of the display device according to the present embodiment. As shown in FIG. 7F, in the first horizontal period of the first field, the outputs WS0 and DS1 are output from the driving section side. Thereby, the pixels (0, 1) of the first line are set in an active state. The pixels (0, 1) set in the active state by the outputs WS0 and DS1 perform Vth cancelling operation on a time division basis over three horizontal periods (three Hs). In the third horizontal period of the three horizontal periods, the pixels perform signal writing operation and mobility correcting operation in addition to the Vth cancelling operation. The pixels further perform pixel lighting operation in response to the output DS1. The phases of the outputs WS0 and DS1 overlap each other over two horizontal periods. The Vth cancelling operation and the like are performed normally in the state of the phases of the outputs WS0 and DS1 overlapping each other.

The pixels can illuminate for a maximum of one field period, depending on the outputs DS. The pixels that have illuminated in the first field period do not illuminate in the second field period. Thus, the illumination time of a pixel in one frame period is one field period at a maximum, and therefore a light emission duty is 50% at a maximum.

Figure 7G:
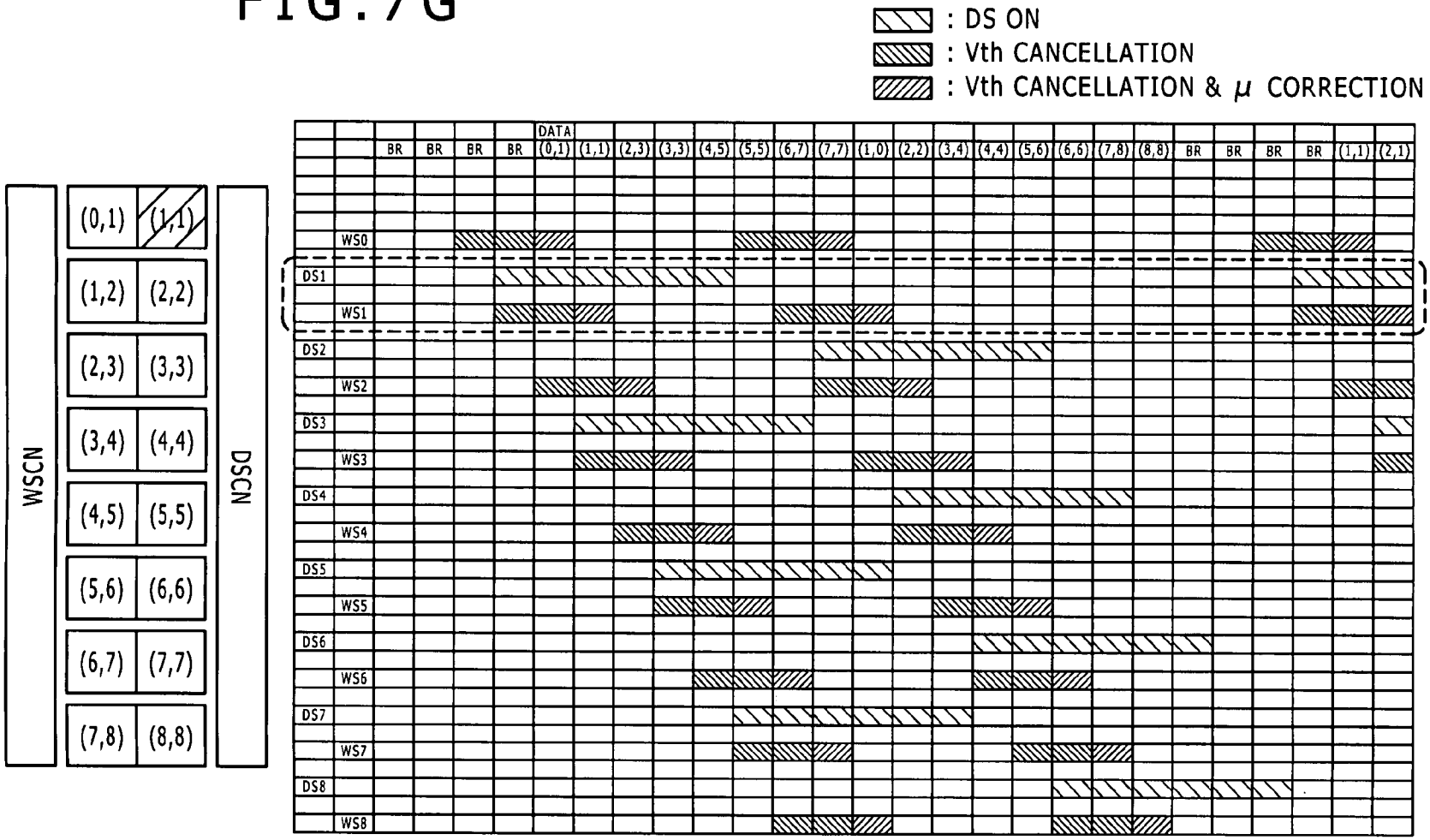
FIG. 7G is similarly a block chart showing the operation sequence of the display device shown in FIG. 7C.

FIG. 7G is a block chart when the phase has advanced by one H in the first field. As shown in FIG. 7G, the outputs DS1 and WS1 are output from the driving section side to pixels of the same first line. In response to the outputs WS1 and DS1, the even-numbered pixels (1, 1) are activated, and then make a transition to a light emitting state as indicated by hatching.

Figure 7H:
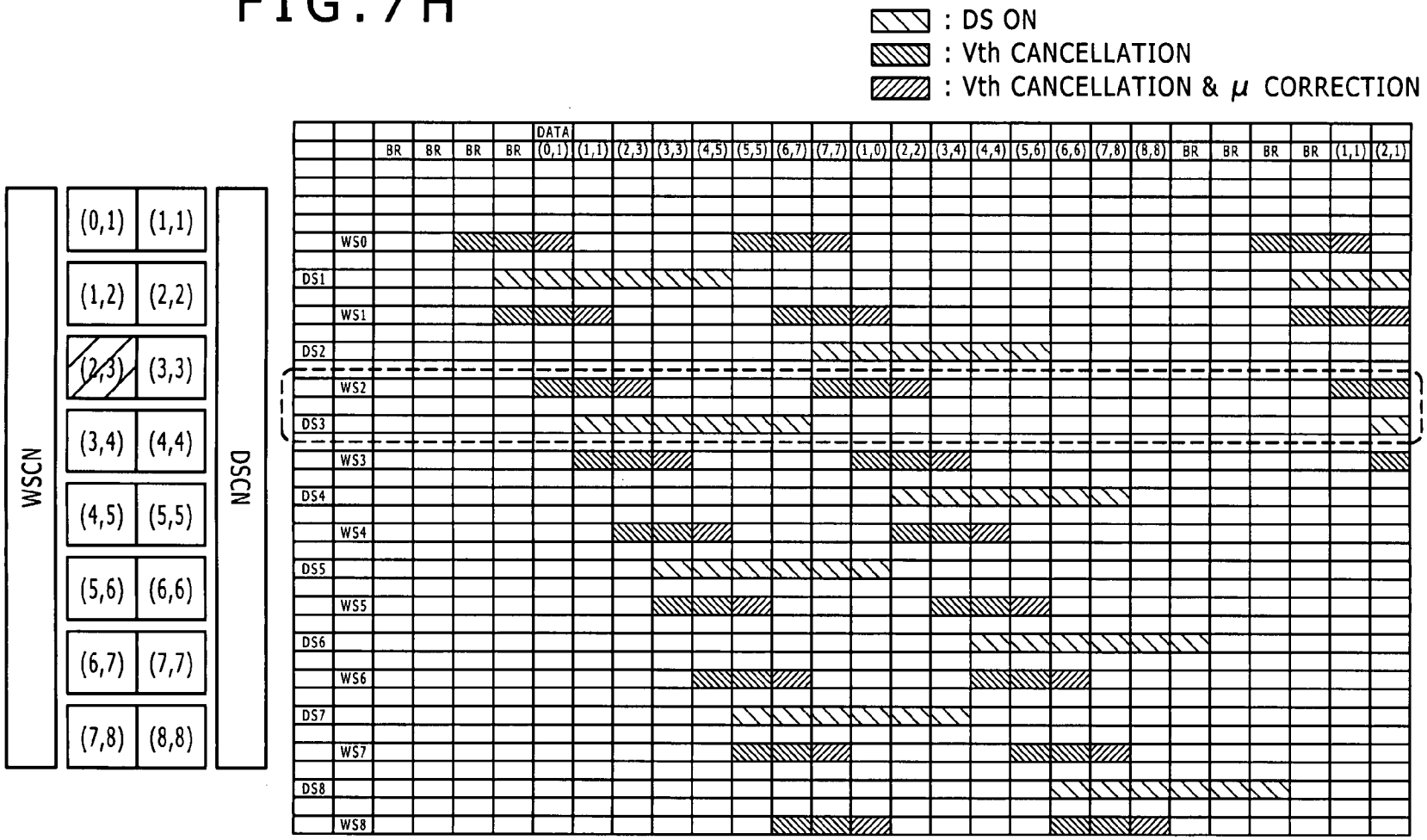
FIG. 7H is similarly a block chart showing the operation sequence of the display device shown in FIG. 7C.

FIG. 7H is a block chart when the operation sequence has further advanced by one H. At this point, the outputs WS2 and DS3 are output from the driving section side to the pixels of the third line in the first field. As shown in FIG. 7H, in the third line, the odd-numbered pixels (2, 3) are set in a selected state in response to the outputs WS2 and DS3. Hence, the hatched odd-numbered pixels (2, 3) emit light.

Figure 7I:
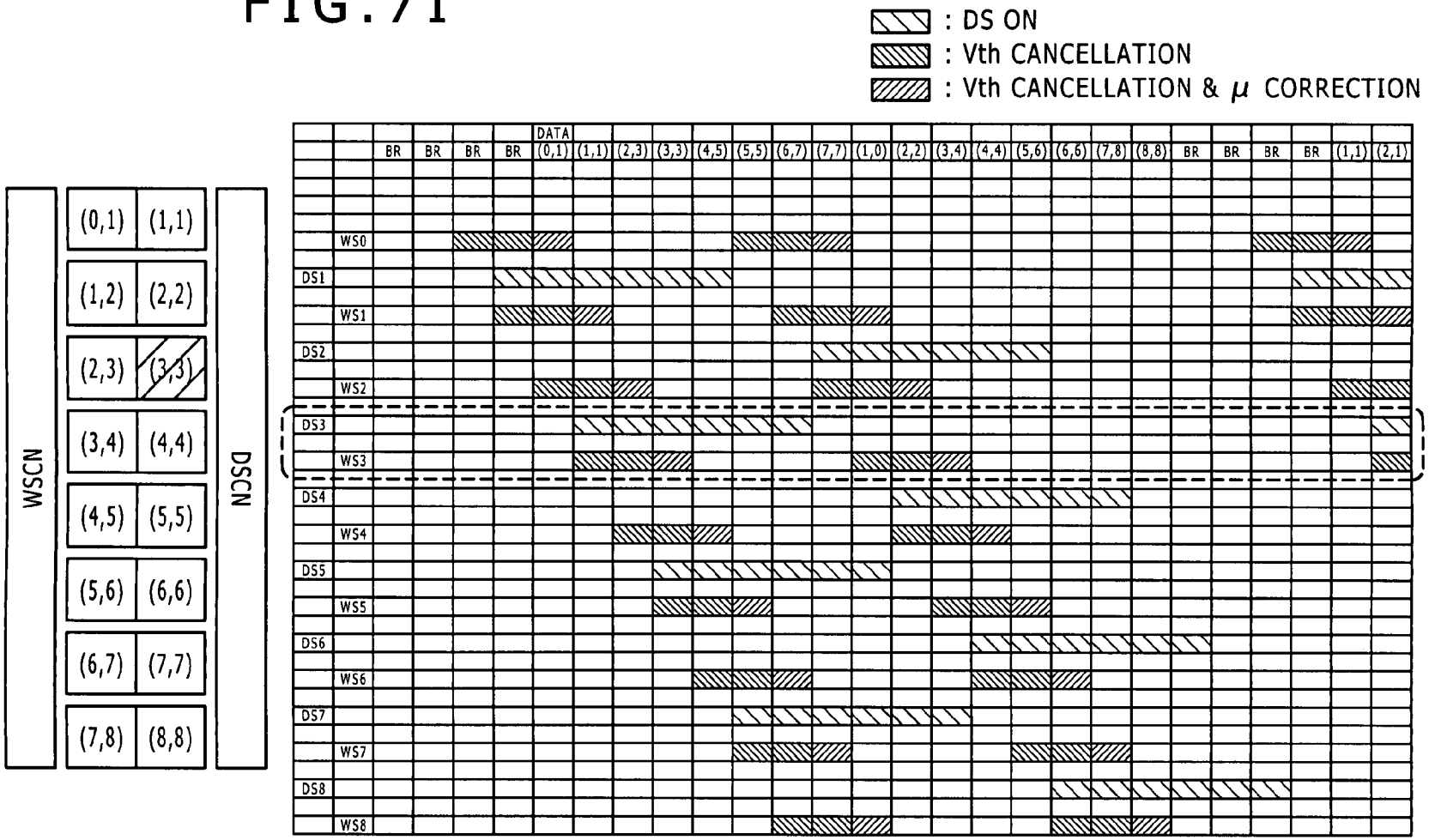
FIG. 7I is similarly a block chart showing the operation sequence of the display device shown in FIG. 7C.

FIG. 7I is a block chart when the operation sequence has further advanced by one H. As shown in FIG. 7I, the outputs WS3 and DS3 are output from the driving section side to the pixels of the same third line. The even-numbered pixels (3, 3) in the pixel row of the third line are set in a selected state, and then emit light as indicated by hatching. Thus, in the first field, half of all the 16 pixels, that is, the 8 pixels belonging to the odd lines are set in an active state, and emit light according to the video signal supplied from the respective signal lines. Thereafter the second field period begins. The sequential scanning of the pixel array section is performed again so that the pixels remaining in a non-selected state in the even lines are selected and made to emit light at a luminance corresponding to the video signal. When the first field and the second field are thus completed, an image of one frame is displayed on the pixel array section.

Figure 8:
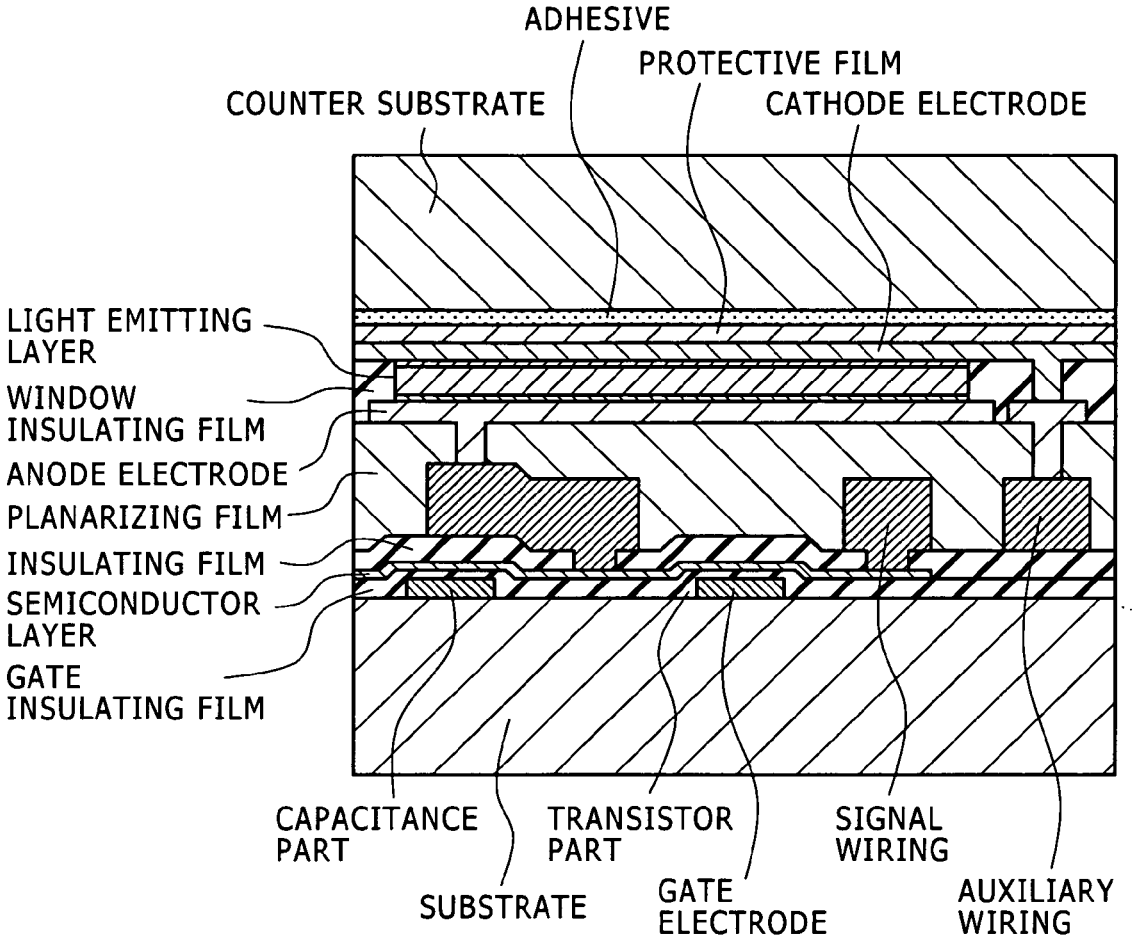
FIG. 8 is a sectional view of a device structure of a display device according to an embodiment of the present invention.

A display device according to an embodiment of the present invention has a thin-film device structure as shown in FIG. 8. The figure schematically shows a sectional structure of a pixel formed on an insulative substrate. As shown in FIG. 8, the pixel includes a transistor part including a plurality of thin film transistors (the figure shows one TFT), a capacitance part such as a storage capacitor or the like, and a light emitting part such as an organic EL element or the like. The transistor part and the capacitance part are formed on the substrate by a TFT process, and the light emitting part such as an organic EL element or the like is laminated over the transistor part and the capacitance part. A transparent counter substrate is laminated over the light emitting part via an adhesive to form a flat panel.

Figure 9:
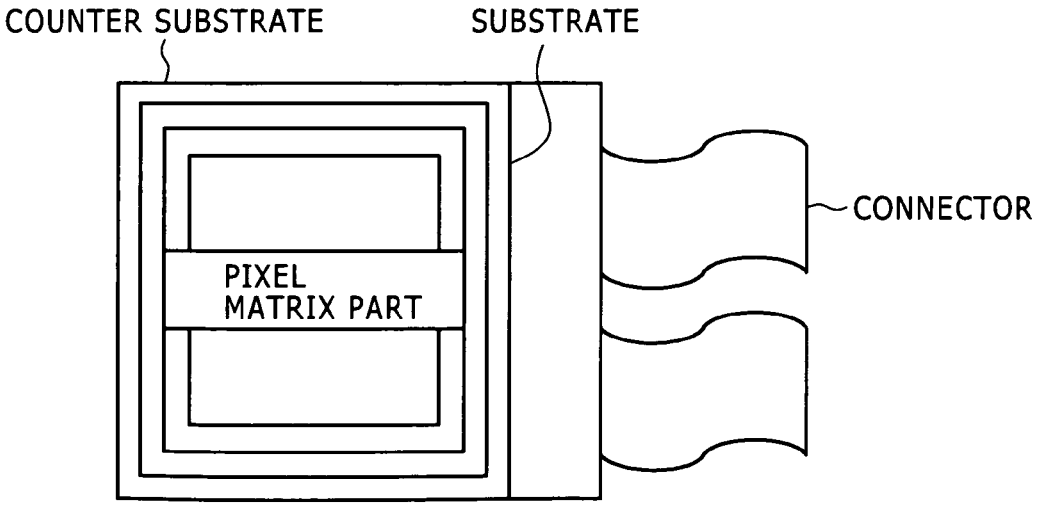
FIG. 9 is a plan view of a modular constitution of a display device according to an embodiment of the present invention.

A display device according to an embodiment of the present invention includes a display device of a flat module shape as shown in FIG. 9. For example, a pixel array section in which pixels each including an organic EL element, a thin film transistor, a thin film capacitance and the like are integrated and formed in the form of a matrix is disposed on an insulative substrate. An adhesive is disposed in such a manner as to surround the pixel array section (pixel matrix part), and a counter substrate such as a glass or the like is laminated to form a display module. The transparent counter substrate may be provided with a color filter, a protective film, a light shielding film and the like as required. The display module may be provided with a FPC (flexible printed circuit), for example, as a connector for externally inputting or outputting a signal and the like into the pixel array section.

The display devices according to the above-described embodiments of the present invention have a flat panel shape, and are applicable to displays of various electronic devices in every field that display a video signal input to the electronic devices or generated within the electronic devices as an image or video, the electronic devices including for example a digital camera, a notebook personal computer, a portable telephone, and a video camera. An example of electronic devices to which such a display device is applied will be illustrated in the following.

Figure 10:
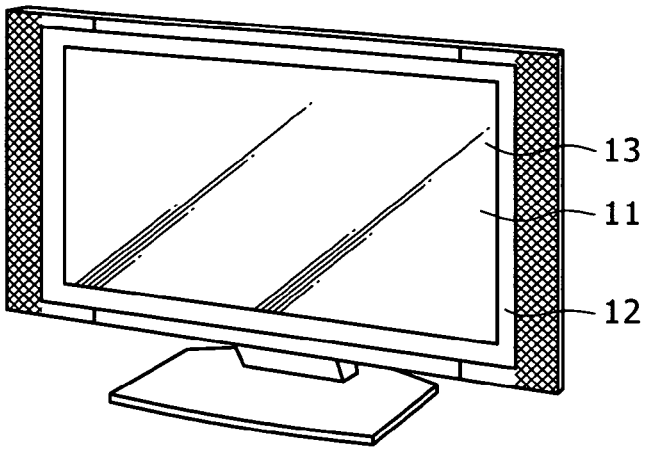
FIG. 10 is a perspective view of a television set having a display device according to an embodiment of the present invention.

FIG. 10 shows a television set to which the present invention is applied. The television set includes a video display screen 11 composed of a front panel 12, a filter glass 13 and the like. The television set is fabricated using a display device according to an embodiment of the present invention as the video display screen 11.

Figure 11:
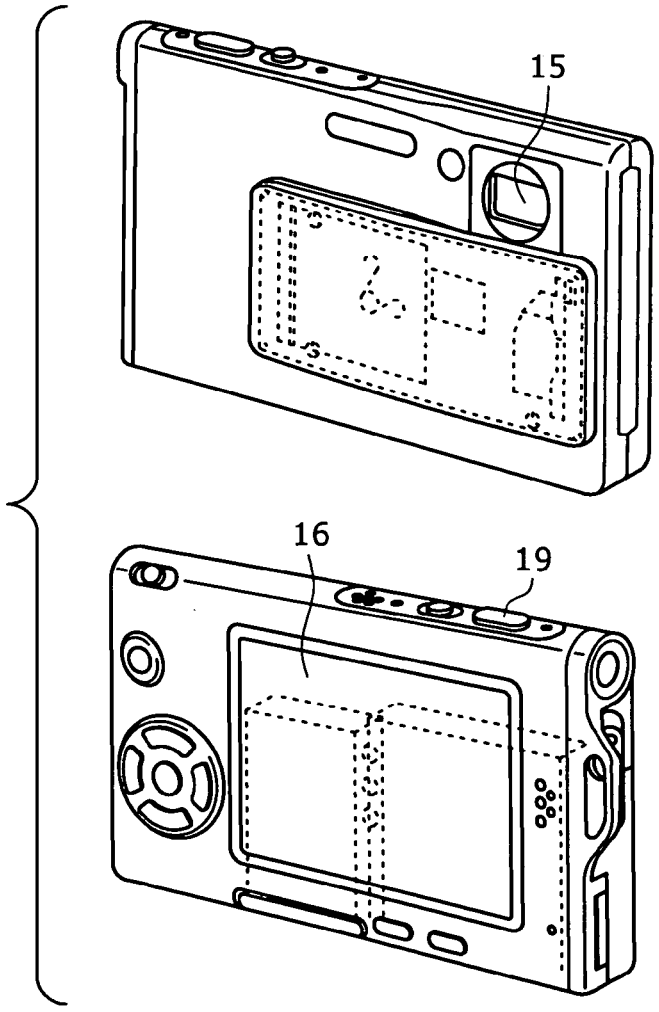
FIG. 11 is a perspective view of a digital still camera having a display device according to an embodiment of the present invention.

FIG. 11 shows a digital camera to which the present invention is applied, an upper part of FIG. 11 being a front view, and a lower part of FIG. 11 being a rear view. The digital camera includes an image pickup lens, a light emitting section 15 for flashlight, a display section 16, a control switch, a menu switch, a shutter 19 and the like. The digital camera is fabricated using a display device according to an embodiment of the present invention as the display section 16.

Figure 12:
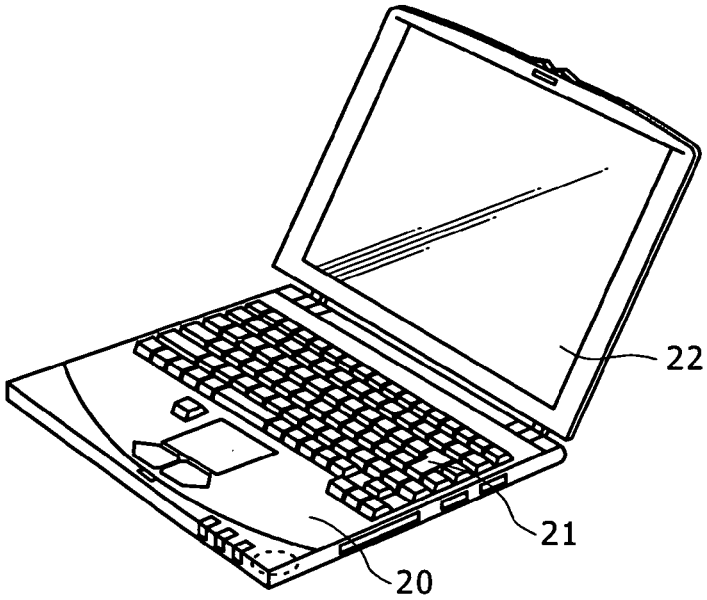
FIG. 12 is a perspective view of a notebook personal computer having a display device according to an embodiment of the present invention.

FIG. 12 shows a notebook personal computer to which the present invention is applied. A main unit 20 of the notebook personal computer includes a keyboard 21 operated to input characters and the like, and a main unit cover of the notebook personal computer includes a display section 22 for displaying an image. The notebook personal computer is fabricated using a display device according to an embodiment of the present invention as the display section 22.

Figure 13:
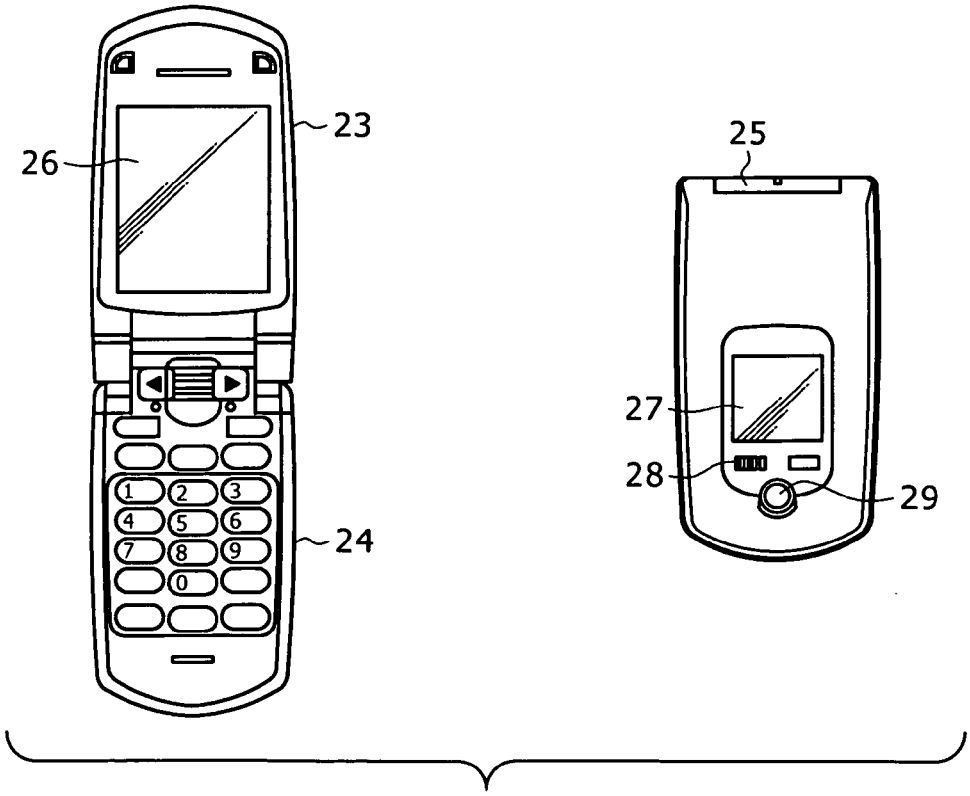
FIG. 13 is a schematic diagram showing a portable terminal device having a display device according to an embodiment of the present invention.

FIG. 13 shows a portable terminal device to which the present invention is applied, a left part of FIG. 13 showing an opened state of the portable terminal device, and a right part of FIG. 13 showing a closed state of the portable terminal device. The portable terminal device includes an upper side casing 23, a lower side casing 24, a coupling part (a hinge part in this case) 25, a display 26, a sub-display 27, a picture light 28, a camera 29 and the like. The portable terminal device is fabricated using a display device according to an embodiment of the present invention as the display 26 and the sub-display 27.

Figure 14:
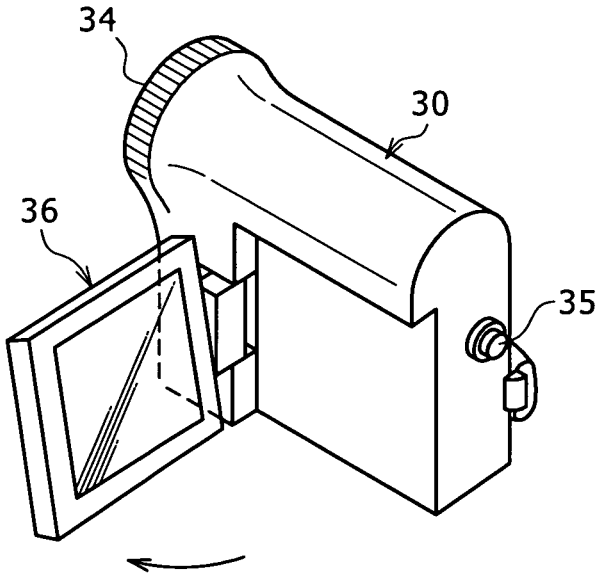
FIG. 14 is a perspective view of a video camera having a display device according to an embodiment of the present invention.

FIG. 14 shows a video camera to which the present embodiment is applied. The video camera includes a main unit 30, a lens 34 for taking a picture of a subject, which lens is situated on a side facing frontward, a start/stop switch 35 at the time of picture taking, a monitor 36, and the like. The video camera is fabricated using a display device according to an embodiment of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array section including a set of pixels arranged in a form of a matrix having columns and rows; and a driving section for driving the pixel array section;

wherein the pixel array section has signal lines in a column direction arranged at a ratio of one signal line to two pixel columns, first driving lines in a row direction arranged at a ratio of one first driving line to one pixel row, and second driving lines in a form of rows similarly arranged at a ratio of one second driving line to one pixel row, a signal line is commonly connected to pixels of a corresponding pair of a left column and a right column, a first driving line is connected to pixels of a corresponding row, a second driving line is alternately and exclusively connected to odd-numbered pixels in an upper row and even-numbered pixels in a lower row, the second driving line being disposed between the upper row and the lower row, the driving section includes a horizontal driving circuit for supplying a video signal to the signal lines, a first vertical driving circuit for sequentially supplying a first driving signal to the first driving lines, and a second vertical driving circuit for sequentially supplying a second driving signal to the second driving lines, and each pixel is operated to emit light at a luminance corresponding to the video signal by the first driving signal and the second driving signal, whereby an image is displayed on the pixel array section.

2. The display device according to claim 1, wherein the pixel array section is scanned during one frame period divided into a first field period and a second field period, in the first field period, the first vertical driving circuit sequentially scans the first driving lines and supplies a first driving signal to the first driving lines row by row, while the second vertical driving circuit selectively scans one of a group of odd-numbered second driving lines and a group of even-numbered second driving lines and supplies a second driving signal to the one of the groups, whereby half of pixels included in a pair of a left column and a right column commonly connected to each signal line are operated to emit light, and in the second field period, the first vertical driving circuit sequentially scans the first driving lines and supplies the first driving signal to the first driving lines row by row, while the second vertical driving circuit selectively scans the other of the group of the odd-numbered second driving lines and the group of the even-numbered second driving lines and supplies the second driving signal to the other of the groups, whereby the other half of the pixels included in the pair of the left column and the right column commonly connected to each signal line are operated to emit light.

3. The display device according to claim 2, wherein one frame period is inserted between a preceding blanking period and a succeeding blanking period.

4. The display device according to claim 1, wherein at least one of the pixels includes a sampling transistor, a driving transistor, a storage capacitor, and a light emitting element, a control terminal of the sampling transistor is connected to a scanning line formed by one of the first driving line and the second driving line, a pair of current terminals of the sampling transistor is connected to the signal line and a control terminal of the driving transistor, a first current terminal of the driving transistor is connected to the light emitting element, and a second current terminal of the driving transistor is connected to a feeding line formed by the other of the first driving line and the second driving line, and the storage capacitor is connected between the control terminal and the first current terminal of the driving transistor, and in the pixel, the sampling transistor is turned on in response to a driving signal supplied from the scanning line to sample a video signal from the signal line and write the video signal to the storage capacitor, and the driving transistor operates in response to a driving signal supplied from the feeding line to supply a driving current corresponding to the video signal written to the storage capacitor to the light emitting element.

5. The display device according to claim 4, wherein a correcting operation is performed for a pixel according to the driving signals supplied from the scanning line and the feeding line before writing the video signal to the storage capacitor, whereby the pixel adds an amount of correction for cancelling a variation in threshold voltage of the driving transistor to the storage capacitor.

6. The display device according to claim 5, wherein the correcting operation is repeated a plurality of times on a time division basis.

7. The display device according to claim 6, wherein the correcting operation is performed over three horizontal periods.

8. The display device according to claim 4, wherein an amount of correction is subtracted for cancelling a variation in mobility of the driving transistor from the storage capacitor when writing the video signal to the storage capacitor.

9. The display device according to claim 6, wherein a number of the correcting operations is effectively changed between the first field period and the second field period.

10. The display device according to claim 1, wherein the pixels in the left column and the pixels in the right column are activated at different times.

11. An electronic device comprising:

a display device including a pixel array section including a set of pixels arranged in a form of a matrix having columns and rows; and a driving section for driving the pixel array section;

wherein the pixel array section has signal lines in a column direction arranged at a ratio of one signal line to two pixel columns, first driving lines in a row direction arranged at a ratio of one first driving line to one pixel row, and second driving lines in a form of rows similarly arranged at a ratio of one second driving line to one pixel row, a signal line is commonly connected to pixels of a corresponding pair of a left column and a right column, a first driving line is connected to pixels of a corresponding row, a second driving line is alternately and exclusively connected to odd-numbered pixels in an upper row and even-numbered pixels in a lower row, the second driving line being disposed between the upper row and the lower row, the driving section includes a horizontal driving circuit for supplying a video signal to the signal lines, a first vertical driving circuit for sequentially supplying a first driving signal to the first driving lines, and a second vertical driving circuit for sequentially supplying a second driving signal to the second driving lines, and each pixel is operated to emit light at a luminance corresponding to the video signal by the first driving signal and the second driving signal, whereby an image is displayed on the pixel array section.

12. The electronic device according to claim 11, wherein the pixel array section is scanned during one frame period divided into a first field period and a second field period, in the first field period, the first vertical driving circuit sequentially scans the first driving lines and supplies a first driving signal to the first driving lines row by row, while the second vertical driving circuit selectively scans one of a group of odd-numbered second driving lines and a group of even-numbered second driving lines and supplies a second driving signal to the one of the groups, whereby half of pixels included in a pair of a left column and a right column commonly connected to each signal line are operated to emit light, and in the second field period, the first vertical driving circuit sequentially scans the first driving lines and supplies the first driving signal to the first driving lines row by row, while the second vertical driving circuit selectively scans the other of the group of the odd-numbered second driving lines and the group of the even-numbered second driving lines and supplies the second driving signal to the other of the groups, whereby the other half of the pixels included in the pair of the left column and the right column commonly connected to each signal line are operated to emit light.

13. The electronic device according to claim 12, wherein one frame period is inserted between a preceding blanking period and a succeeding blanking period.

14. The electronic device according to claim 11, wherein at least one of the pixels includes a sampling transistor, a driving transistor, a storage capacitor, and a light emitting element, a control terminal of the sampling transistor is connected to a scanning line formed by one of the first driving line and the second driving line, a pair of current terminals of the sampling transistor is connected to the signal line and a control terminal of the driving transistor, a first current terminal of the driving transistor is connected to the light emitting element, and a second current terminal of the driving transistor is connected to a feeding line formed by the other of the first driving line and the second driving line, and the storage capacitor is connected between the control terminal and the first current terminal of the driving transistor, and in the pixel, the sampling transistor is turned on in response to a driving signal supplied from the scanning line to sample a video signal from the signal line and write the video signal to the storage capacitor, and the driving transistor operates in response to a driving signal supplied from the feeding line to supply a driving current corresponding to the video signal written to the storage capacitor to the light emitting element.

15. The electronic device according to claim 14, wherein a correcting operation is performed for a pixel according to the driving signals supplied from the scanning line and the feeding line before writing the video signal to the storage capacitor, whereby the pixel adds an amount of correction for cancelling a variation in threshold voltage of the driving transistor to the storage capacitor.

16. The electronic device according to claim 15, wherein the correcting operation is repeated a plurality of times on a time division basis.

17. The electronic device according to claim 16, wherein the correcting operation is performed over three horizontal periods.

18. The electronic device according to claim 14, wherein an amount of correction is subtracted for cancelling a variation in mobility of the driving transistor from the storage capacitor when writing the video signal to the storage capacitor.

19. The electronic device according to claim 16, wherein a number of the correcting operations is effectively changed between the first field period and the second field period.

20. The electronic device according to claim 11, wherein the pixels in the left column and the pixels in the right column are activated at different times.

* * * * *